US006554956B1

(12) United States Patent
Dolan et al.

(10) Patent No.: US 6,554,956 B1
(45) Date of Patent: Apr. 29, 2003

(54) METHOD AND APPARATUS FOR SEALING CLOSED ENVELOPES

(75) Inventors: Donald T. Dolan, Ridgefield, CT (US); Pushpavadan S Nagarsheth, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/675,329

(22) Filed: Sep. 28, 2000

(51) Int. Cl.[7] ..... B65B 7/20

(52) U.S. Cl. ..... 156/441.5; 156/442.1; 156/442.2; 53/131.2

(58) Field of Search ..... 156/44.15, 442.2, 156/442.1, 442.3, 442.4; 118/300, 315, 312; 53/131.2, 284.3

(56) References Cited

U.S. PATENT DOCUMENTS

| | | | | |
|---|---|---|---|---|
| 4,730,820 A | | 3/1988 | Fluckiger | 270/58 |
| 4,753,432 A | | 6/1988 | Freeman | 271/35 |
| 4,935,078 A | * | 6/1990 | Bergman et al. | 156/360 |
| 4,956,782 A | | 9/1990 | Freeman et al. | 364/464.03 |
| 5,007,371 A | * | 4/1991 | O'Dea et al. | 118/323 |
| 5,098,734 A | | 3/1992 | O'Dea et al. | 427/8 |
| 5,217,551 A | | 6/1993 | Nobile et al. | 156/64 |
| 5,242,499 A | | 9/1993 | Bergman | 118/669 |
| 5,331,538 A | | 7/1994 | DiGiulio et al. | 364/134 |
| 5,489,358 A | | 2/1996 | Miciukiewicz | 156/366 |
| 5,569,327 A | | 10/1996 | Paradis | 118/253 |
| 5,809,752 A | | 9/1998 | Holbrook | 53/569 |
| 6,014,569 A | | 3/2000 | Freeman et al. | 53/131.2 |
| 6,361,603 B1 | * | 3/2002 | Salomon | 118/300 |

* cited by examiner

*Primary Examiner*—Richard Crispino
*Assistant Examiner*—Sue A. Purvis
(74) *Attorney, Agent, or Firm*—Christopher J. Capelli; Steven J. Shapiro; Angelo N. Chaclas

(57) ABSTRACT

The present invention is directed to an envelope processing system system in which a supply of envelopes is placed for moistening and sealing. The moistening and sealing apparatus is designed to receive all types of intermixed mail envelopes with various shaped flaps. The envelopes may be loaded into the supply station in different configurations including intermixed with closed sealed flaps, unsealed open flaps, or closed unsealed flaps. The system is designed.to receive such envelopes, process them so that the flaps are automatically closed prior to moistening if they are not closed. The flaps of the envelopes are then moistened indirectly using capillary action of a sealing agent, and sealed with a sealing apparatus.

6 Claims, 14 Drawing Sheets

METHOD AND APPARATUS FOR SEALING CLOSED ENVELOPES

FIELD OF THE INVENTION

The present invention is related to the moistening of envelope flaps without the need to separate the flap from the body of the envelope. Previously, it was necessary to create an open space between a gummed or glue coated flap and the envelope body in order to apply a moisturizing agent or sealant prior to sealing envelopes. The present invention eliminates that requirement to create a gap or open space in order to moisten the flap of envelopes.

BACKGROUND OF THE INVENTION

This invention is generally concerned with envelope-processing machines or equipment that moisten and seal envelope flaps. Such equipment may include as a minimum, apparatus and components used to moisten the glued or gummed flaps of envelope stock. An example of the type of machine where this part of the process is usually desired is a mailing machine. The invention is particularly aimed at handling of mail, or envelopes that may be supplied for processing in one of three different flap configurations involving orientation or position of the flap. Those flap configurations are namely closed and sealed, unsealed open flap, and unsealed closed flap. These different configurations are sometimes a matter of preference of an operator in that they are loaded into the machine in one of the three configurations. Other preferences may be desirable, including one where all envelopes are mixed together with the flaps oriented in different directions. The present invention is directed to moistening the flaps of all three flap configurations where moistening an envelope flap while the flap is closed without the need to have the glued flap directly contacted by a moistening device, which is done in the prior art.

In each flap configuration, the envelopes are positioned for processing that includes feeding them through the machine, moistening the flap, and sealing them. The result is a piece of mail formed from the sealed envelope that will be printed with a postal indicia or address. Up to the present time, mailing equipment operators have often been forced to hand separate the envelopes into separate piles of sealed closed flap, unsealed with open flap, and unsealed closed flaps. This separation process is usually necessary with some mailing equipment currently available in the field because the equipment is not able to process all three-flap configurations with a single set-up. Therefore, an adjustment of the equipment is often required before each of the different envelope flap configurations can be processed. The present invention will solve this problem since it will no longer be necessary to segregate the envelopes or mail prior to feeding them through the processing equipment.

One exception to the foregoing regarding the state of the art lies in a line of mailing equipment manufactured by Pitney Bowes Inc. of Stamford Conn. In this equipment a design is seen where it is presently possible to separate, feed, moisten, and seal mixed types of envelopes in one machine without multiple set-up requirements. An example of how this is done may be seen in the Paragon ® Model Mailing Machine, manufactured by Pitney Bowes Inc. In the Paragon ® equipment, a supply of mixed sizes of envelopes may be placed into the feed hopper from where they are separated using a separation and feeding device. The flaps of each envelope are stripped, or separated from the body of the envelope, the flap is measured for its individual shape or profile, and then eventually the flap is moistened, or not, depending on the operator's needs. After moistening, it is usually necessary to seal the flap to the body of the envelope, and a sealing device is arranged just downstream of the moistener to do this.

The problems encountered with feeding different types of envelopes in such equipment is well known in the typical mail room facility. Specific problems dealing with jams caused by feeding envelopes or mail with open or closed flaps is well known. Open flapped envelopes can be the easiest to handle, since a guide member or guide blade will guide the flap and strip it as the envelope progresses along the mailing equipment feed path. The open flapped envelopes are loaded into the machine at the input end of the machine with the flaps lying generally perpendicular with respect to the body of the envelope. An example of this type of mail processor may be seen in U.S. Pat. No. 4,730,821 to Fluckiger. With this design, the water or sealant is eventually applied to the gummed area of the envelope by belts, brushes, pads, spray and so forth, before being forcibly closed and sealed by another sealing apparatus located downstream in the machine.

Different envelope flap configuration or orientation, especially with a mixed envelope situation can cause feeding problems. The flaps may become stuck or jammed at the stripper blades located in the envelope feed path for example. And, there is a special problem developed when feeding closed, sealed envelope through the equipment having these stripper blades. The blades may attempt to open the previously closed seal, and in so doing will jam at the stripper blade. The typical stripper blade is designed to open any envelope moving towards the moistening system, and invariably the blade will cause a jam when encountering a sealed flap. This is a problem the present invention solves since no stripping blade is required as will be evident in the following specification.

Yet another flap configuration involves those envelopes that are loaded into the machine with the flap unsealed lying parallel or nearly so with respect to the envelope body. The flap is usually tucked beneath the body, and then when reaching the stripper blade, forced opened. An example of this may be seen in U.S. Pat. No. 5,217,551 to Noble et al. This patent is another example where in mailing equipment, the moistening system must open the flap slightly to allow for a brush or pad to wet the gummed inside flap area, and then re-close the flap in a following sealing mechanism downstream of the moistening apparatus. It is difficult to design the stripper blade and accompanying wetting members to insure there is sufficient sealant to cover the entire length of the gummed portion of the envelope flap. And, the stripper blade itself must be designed in the shape of the gap to be opened, which is a difficult part to manufacture. There are many different designs of stripper blades and associated components. These designs are all seen in the prior art as they are used to accomplish the flap moistening process. These designs often have many parts involved that have to be serviced due to wear and tear as a result of the repeated contact with the glue on the envelopes and mail. The present invention will solve this problem since there will be reduced supporting components necessary to moisten the flaps, as will be seen in the following description.

A further complication exists in the prior art in related equipment where the envelopes are loaded into the machine in a mixed flap configuration. There must be various sensing devices incorporated into the machine in this case. The sensors must be used to determine what configuration or attitude each envelope flap is prior to or during processing in the equipment. The moistening systems of the prior art typically are designed to process a separated or open flap so that downstream apparatus including the moistening device may be employed. The problem with handling such mixed mailing type envelopes become apparent when it is recognized that there is a very large design spectrum for manufactured envelopes. The envelopes and flaps may be of all sizes, and shapes in many combinations. Therefore, the envelope processing equipment designed to handle this situation becomes quite complicated in anticipation of how each type of envelope must be recognized, and processed using special mechanisms, or apparatus to avoid jams in the machine. The very physical attributes of these mechanisms may themselves cause jams along any part of the feed path of the machine. And, the very nature of having to perform the operation of sensing open or closed flap envelopes, and applying a stripping function in the process apparatus that costly additional hardware is needed thereby driving up the manufacturing cost of the equipment. This problem is solved by the technology of the present invention. It does not matter what configuration the envelopes are in as will be come evident in the following description and embodiments.

With the foregoing in mind, the present invention will demonstrate a way to moisten envelope flaps fed along a processing path. The invention will show how this is done while the envelope flap remains in a folded over or closed orientation. The new moistening process disclosed within overcomes all problems encountered heretofore by the use of the new technology described in the following specification and drawings. The present invention will handle all configurations of envelopes with the flaps in all orientation and configurations possible with little or no damage to the contents of the envelope. In addition, the present invention does this with less components and parts necessary to process the envelopes in a feed path where moistening is a key part of the process. In addition, the equipment described in this invention will process pre-sealed envelopes, without the requirement or possible error of attempting to open or expose the flap for a moistening process, thus providing a high degree of reliability.

SUMMARY OF THE INVENTION

The present invention is concerned with providing an envelope processing system that can moisten the flap of the envelopes while the flaps are in a closed condition. The system will moisten the flaps of all envelopes regardless of whether they have different flap shapes or profiles. In addition, the system will process the envelopes with an open flap, unsealed closed flap, or sealed closed flap configuration. The system can advance the different envelope configurations along a feed path towards the moistening and sealing stations. The system will detect the edge shape of the different flap configurations since the flap of all is closed automatically to a position where the edge profile may be measured electronically. The shape of each flap shape and profile is measured and stored in a register for later use as the envelope passes through a moistening system. When the envelope measured arrives at the moistening station, the controlling microprocessor recalls the stored data concerning the flap profile. At this time, the moistening apparatus applies a liquid sealant along and over the area defined by the shape of the flap so that capillary action can occur. The sealant migrates via capillary action along the edge of the flap, eventually migrating in a band over the glued portion of the flap on each envelope.

Several embodiments of the present invention are described that will demonstrate the applicability of the system to envelope processing equipment.

DESCRIPTION OF THE INVENTION

Figure 1:
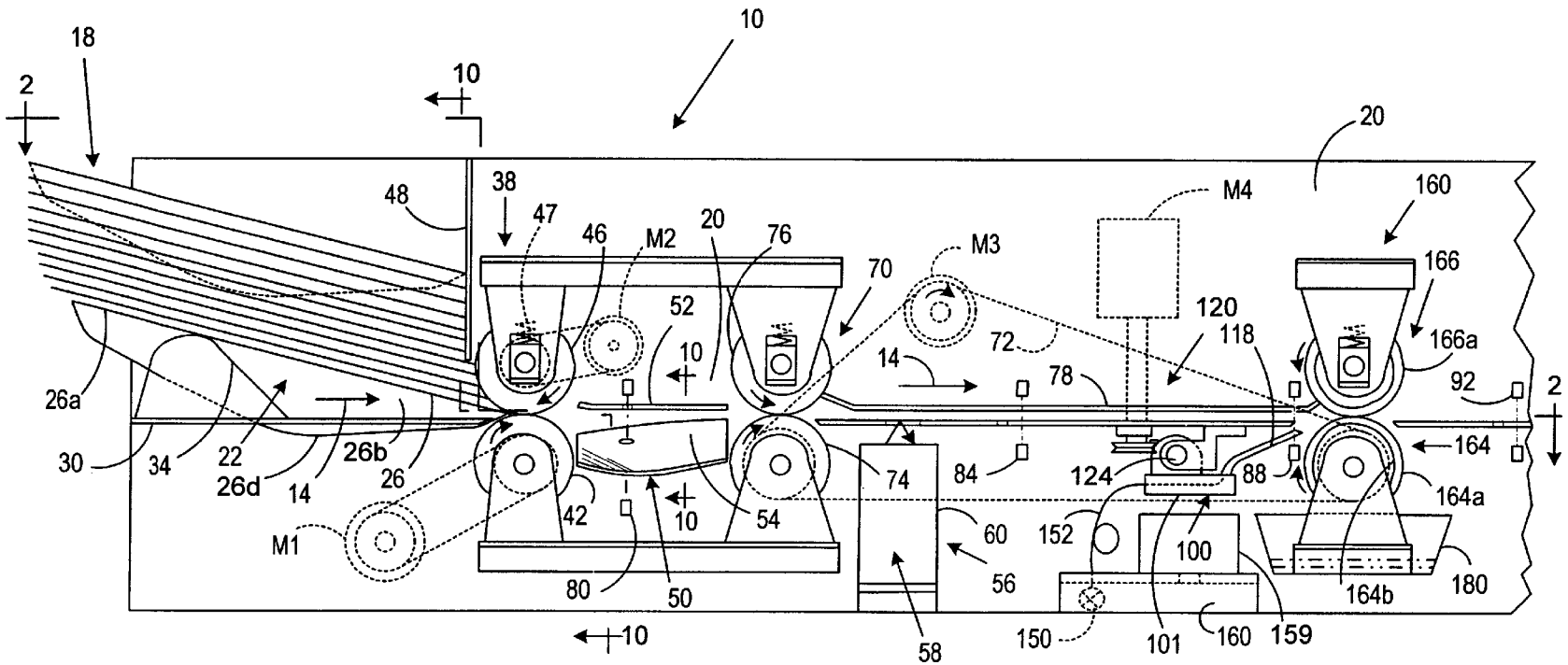
FIG. 1 represents an elevation view of a mailing machine, the view focused on the feeding, envelope flap closing, moistening and sealing areas of the equipment.

Referring to FIG. 1, there is shown an envelope processing machine in the form of a mailing machine 10, having a feed path 14 and a supply of envelopes 18. The mailing machine is typical of that described in prior U.S. Patents assigned to Pitney Bowes Inc. such as U.S. Pat. No. 4,753,432 to Freeman for FEEDER MODULE. This reference is pertinent since it illustrates the use of a reverse roll feeding apparatus for separating the mail, and has a brief discussion of the other usual functions of such mailing equipment of this type. Mailing machines per se are well-known and as such process mail in the form of envelopes, postcards and mailing strip tape. The portion of the mailing machine 10 that applies postal indicia is located downstream in the feed path 14, and is not shown in this view since the object of the present invention resides primarily in the area of envelope feeding, flap profiling and flap moistening. Accordingly, those skilled in the art will understand that the remainder of the functions of mailing equipment in this invention are available and can be applied to the present invention.

The focus of the present invention will now be drawn to feeding an envelope from a supply station, closing the flap of the envelope if it is open, and moistening the flap. This will be done once the envelope flap is digitally scanned into a data collection device for eventually predetermined local application of a sealant to the flap area of the envelope. This is done on the outer surface comprising the back of the envelope where the flap is joined to the envelope body so that the sealant may migrate under capillary action to the covered glue section of the flap. In the course of accomplishing this, the invention will teach how it is possible to process envelopes being loaded into the equipment with a number of possible configurations. These configurations especially include the flap orientation as the envelopes are placed into the machine in an open, closed, or sealed relationship to the body of the envelope. With this the, those skilled in the art will understand the equipment being described in this specification will deliver a sealed envelope that can be appropriately printed with postal indicia or otherwise processed in other types of envelope processing equipment where sealing of the flaps is required or desired.

Figure 2:
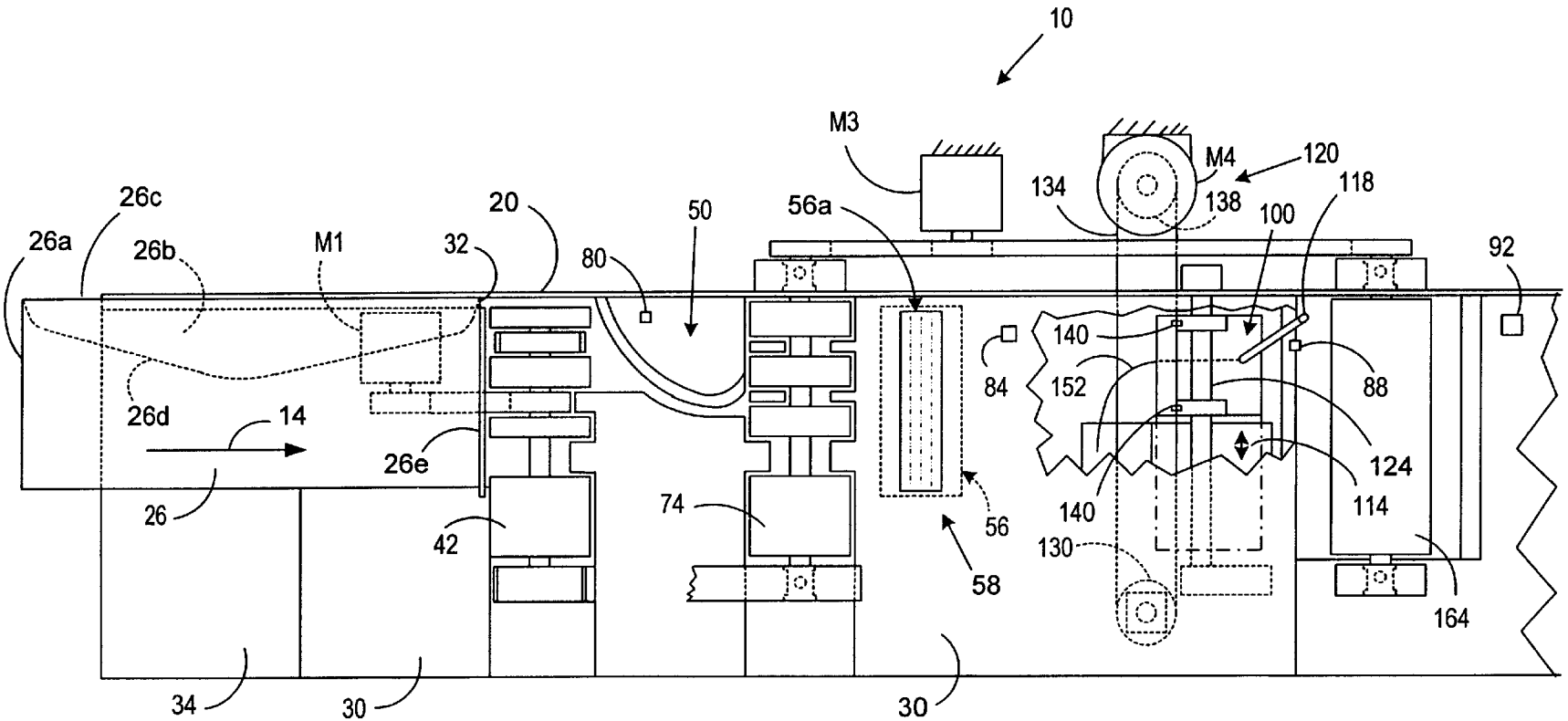
FIG. 2 is a plan view generally taken along the lines of 2—2 in broken parts to show details of the apparatus shown in FIG. 1.

The supply of envelopes 18 is arranged in an input hopper 22 such that a lower envelope 26 rests on an input side of a structural support deck 30 while a trailing end 26*a* of the envelope 26 rests on an upstanding envelope prop 34. Referring to FIG. 1 and FIG. 2, envelope 26 has a flap 26*b* attached or hinged to an upper section 26*c*, a flap edge profile 26*d*, and a leading end 26*e*. This is a typical construction of an envelope, or receptacle for mail. The flaps may be of different shapes, square, oval, trapezoidal, or triangular, but all are usually hinged at one end of the body of the envelope forming the pocket.

Mentioned previously, envelopes may be supplied in a mixed configuration, meaning that they may be interposed in an arrangement or orientation where flaps are tucked or closed against the body of the envelope. Alternatively, the envelopes may be supplied with the flap previously sealed, and mixed in with those having a "closed" configuration, and those having an open configuration. In FIG. 2 the flap 26*b* is hanging down in an "open" configuration, and so is seen in a vertical position, (which may be some other acute angle) inclining towards the body of the envelope. In the present case, the flap 26*b* is shown partially inclined and hanging into a slot 32, seen in FIG. 2, and FIG. 10. A guide member to be discussed later in this specification will eventually flatten and tuck the hanging flap under the body of the envelope. The envelope flap 26*b* will eventually be flattened to the body of the envelope 26, and therefore be arranged in a substantially parallel relationship with the main body of the envelope. Mentioned previously, flap 26*b* could also be loaded into the supply station so that it is entirely flattened to begin with, (closed configuration, sealed or unsealed) lying about parallel with the major body section of the envelope.

Feeding and transporting envelopes and mail articles having a hinged flap:

Referring to FIG. 1, located just downstream of the supply of envelopes 18 is a typical separation and feeding apparatus 38 used to separate each mailpiece or envelope individually for advancement downstream in the feed path 14. This apparatus is discussed in the aforementioned Freeman patent '432. There is a registration wall 20 formed from the structural base of the machine, the wall 20 spanning the entire length of the feed path 14 in order to register the upper section 26*c* of envelope 26, and all subsequent envelopes processed in the feed path 14.

There is a motor M1 (FIG. 1, FIG. 2) connected to a lower feed roller assembly 42 by apparatus of attached timing pulleys, and a typical timing belt used for the driving system. The motor M1, and all other integrated motor drive devices may be energized in sequence at completion of machine set-up with a start button located on the machine control panel (not shown). Typically, the control panel of mailing equipment permits selection of postage amounts, type of mail to be processed, whether the mail should be weighed, and whether or not to moisten that mail. Upon activation, Motor M1 causes rotation of the roller assembly 42, thereby causing the lowermost envelopes in the supply 18 to advance forward. The other over lying envelope pieces resting on top of envelope 26 are restricted from moving along the feed path by a driven reverse roller 46 (FIG. 1) and a forward restraining wall 48, which is part of the basic structure of the machine. The roller 46 is driven by a motor M2, engaged with appropriate timing initiated at the start operation of the machine. The motor M2 attached timing belt drive and attached pulleys are all similar to that described previously in respect to motor M1, in that conventional known techniques are used for the implementation of same. Motor M1 may be a stepper motor, actively started and stopped to coincide with the desired separation of one mail piece, and permitting an attached overrunning clutch assembly (not shown) to run freely when the envelope 26 is pushed forward along the feed path 14. Roller 46 is typical of the roller combinations in the machine where at least one of the pair is biased towards the other with a spring 47. The combination rollers 42 and 46 are segmented, to aid in the passage of the envelopes through the nip. Appropriate slots in the mounting structure, suitable bearings for roller support are all common to such equipment, and are not discussed here since those skilled in the art are well acquainted with these instrumentality's.

Figure 4:
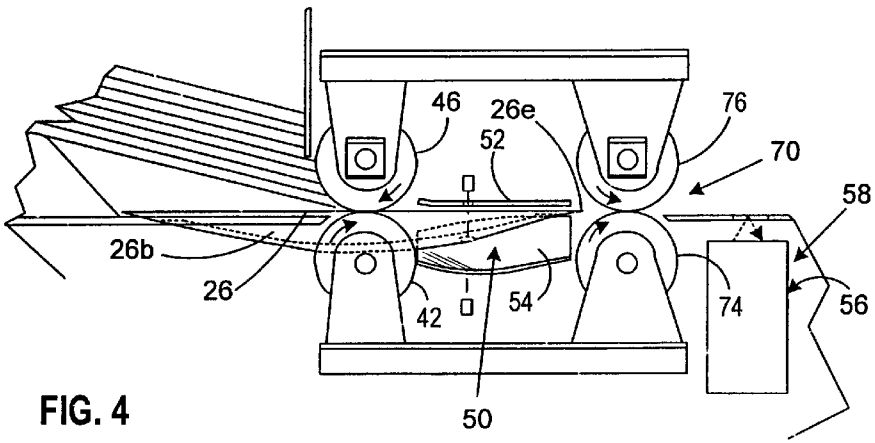
FIG. 4 is a partial elevation view taken from FIG. 3, showing the envelope moving through the flap closing structure.
Figure 5:
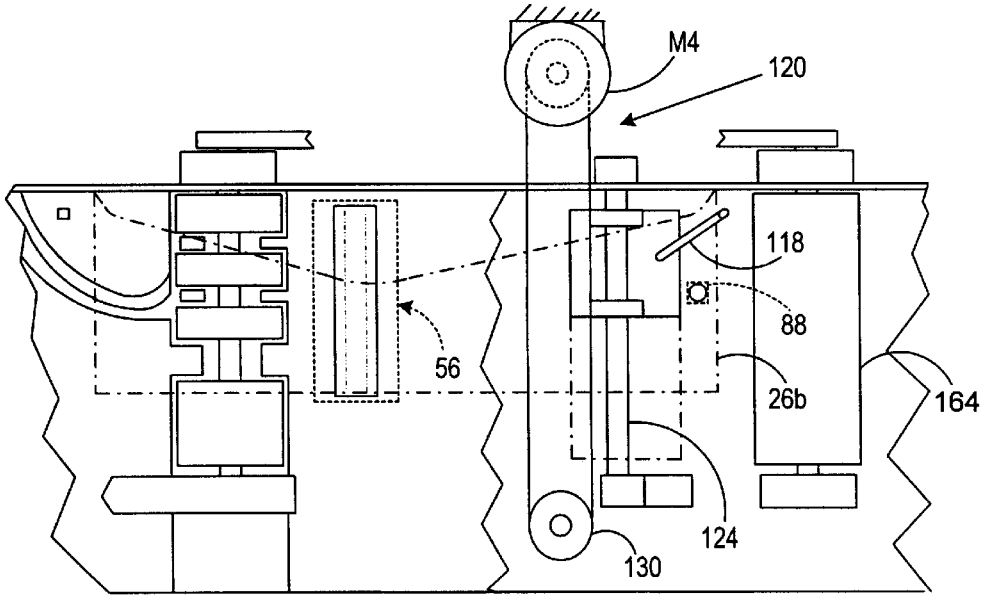
FIG. 5 is another partial view of the mailing machine of FIG. 2, illustrating an envelope moving towards the moistening area.
Figure 10:
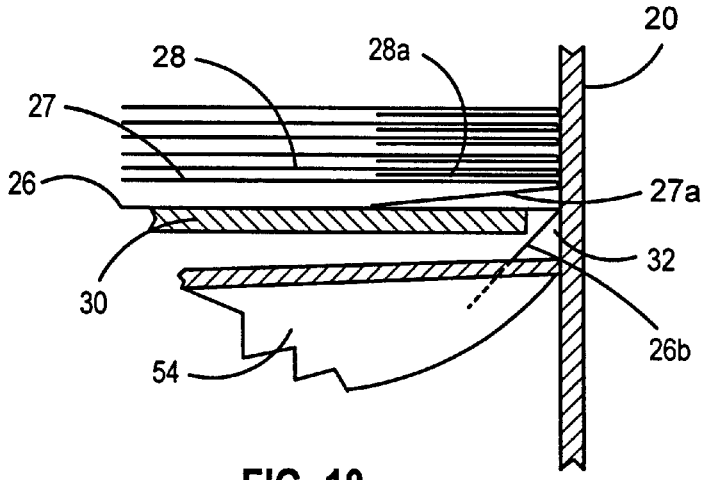
FIG. 10 is a partial sectional view of the machine taken from FIG. 2, along the lines of 10—10, showing a series of steps an open flap envelope goes through in the feed path as it advances downstream in the feed path.

Referring to FIG. 4, envelope 26 is shown in a partial broken out view from FIG. 1. Envelope 26 is shown in position, moving forward along the feed path 14, having just been separated from the supply 18, and advanced slightly beyond the drive roller/separation roller 42/46 combination. FIG. 10 shows an end view of envelope 26, and its flap **26*b* as it hangs down through the slot 32. Also in FIG. 10, an envelope 27 with a flap 27*a* is shown, this envelope having a nearly closed flap configuration. Another envelope 28 is shown above envelope 27, having a closed configuration, with a flap 28*a* being closely aligned with the body of envelope 28**.

Figure 3:
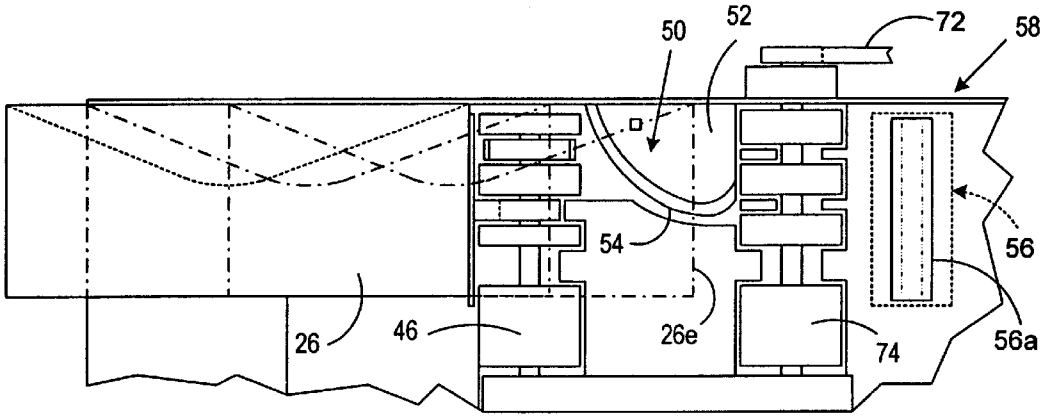
FIG. 3 is a partial plan view of the apparatus of FIG. 1, showing the initial progression of an envelope through the envelope separator, and flap closing area at the input side of the machine.

Referring now to FIG. 3 and FIG. 4, envelope 26 advances under positive control of the driving roller 42, the leading end **26*e* being just beyond the roller nip defined between separator roller 46 and roller 42. An envelope flap closing apparatus 50 is positioned to intercept the leading end 26*e* of envelope 26. The flap closing apparatus 50 has an upper guide member 52, and a lower guide member 54 that encloses an open funnel shaped aperture that is generally aligned with the feed path 14. The lower guide member 54 is shaped into a contour so that its upper surface engages the flap 26*b* of envelope 26 as it moves downstream. The lower guide member 54 ensures that the flap is always forced to a folded back or closed position (the same as envelope 28) as seen in FIG. 10**.

Mentioned previously, some envelopes in supply 18 could be pre-sealed, sealed ahead of time, and mixed into the supply 18 along with other envelopes having an open unsealed configuration and orientation. Pre-sealed envelopes may come from a separate, off-line process, or they could come from processing in the other equipment that is set to seal only those envelopes. In this case, the guides 52 and 54 act as a funneling guide that ensures closed flap and open flap envelopes will equally be processed to arrive at the next set of transport rollers in a similar flap orientation. The pre-sealed envelopes are not affected at all, since there is no stripping blade in the present invention to disturb their seal. Sealed mail is closed, and need not be moistened again, but the operator with equipment at hand that strips the flaps may wish to apply postage on that type without the moistening function. It is possible to have a sensor that would detect such a condition, and therefore, no sealing in the operation would be enabled, and other desired functions such as printing would be enabled.

In the course of feeding the envelopes forward, in the example of envelope 26, hanging down flap **26*b* is guided to the closed position as seen in FIG. 4 and FIG. 10. The surfaces facing upward of lower guide member 54** are designed to accommodate this flap configuration. To more fully understand this, reference may be made to U.S. Pat. No. 6,041,569 to Freeman et al for MAILING MACHINE HAVING ENVELOPE CLOSING AND SEALING DEVICE. That reference shows and illustrates the need and application of an envelope flap-closing device.

Just downstream of the flap closing apparatus 50 there is an array of sensing devices 56 that is part of a flap profile sensor apparatus 58 used to define the envelope flap profile. The array of sensing devices 56 is appropriately mounted and secured beneath the support deck 30 by suitable attachment devices (not shown). The array of sensing devices 56 has a scanning window **56*a*, best seen in FIG. 2. The window 56*a* is clear, enabling the scanning components located beneath the window to scan the features of an envelope passing over it. The array of sensing devices 56 is comprised of a commercially available optical assembly that is able to differentiate between differences in the texture, surfaces and form of paper. In the present case, the array of sensing devices 56 will distinguish between the profile edge shape of an envelope flap and the body of the envelope as it moves over the array of sensing devices 56. The window 56*a*** is designed to cover all the possible widths of envelopes and their respective flaps processed in the system, and will detect all elongated shapes of the edges defining the end of the envelope flap associated with the general design of such envelopes.

Figure 9:
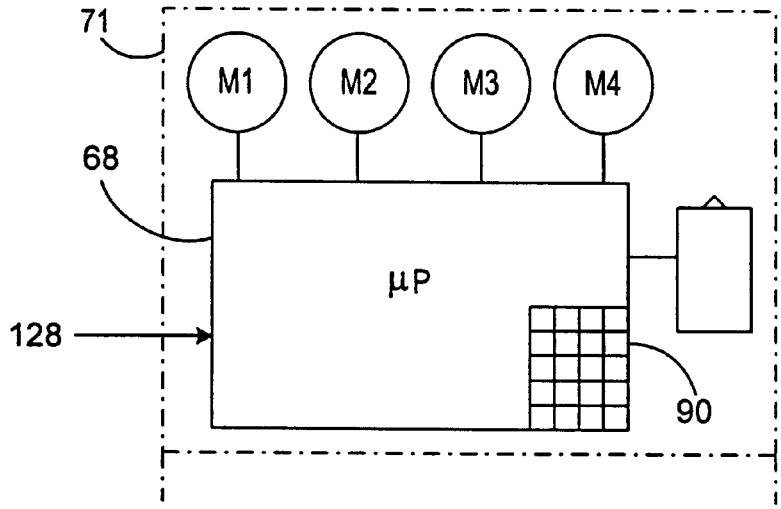
FIG. 9 is a block diagram showing the control system of the apparatus, along with interfacing connections to the driving motors of the mailing machine.
Figure 9A:
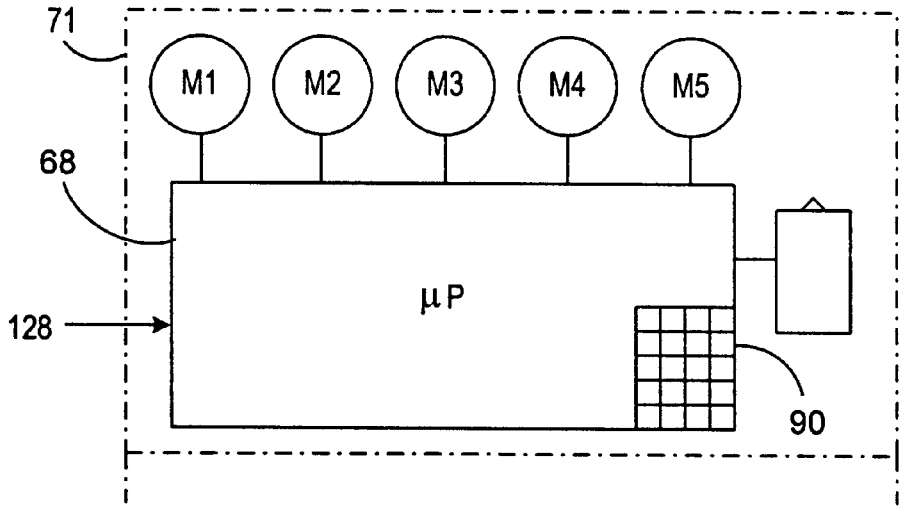
FIG. 9*a* is a block diagram drawn along the same lines as FIG. 9, showing an additional drive motor for another embodiment of the invention.

The array of sensing devices 56 and associated components are similar to that utilized in a Facsimile type scanner with appropriate electronics and accompanying software that will communicate with a microprocessor 68. In the present embodiment, microprocessor 68 is part of a controller 71 (FIG. 9) used to assemble a digital image of each envelope flap scanned by the array of sensing devices 56. And, the controller 71 also is used to communicate sensed data coming from sensing elements and other operating parts of the present mailing machine system. The controller 71 receives the defined details of the edge profile of flaps of each envelope being processed, in a digital format. The array of sensing devices 56 is comprised of CCD or linear sensor technology from the commercial parts and technology mentioned as used in facsimile equipment using associated illumination and optics. Thus, the array of sensing devices 56 provides a scanned image that is recorded and sent electronically in digital format to the microprocessor 68. In the present invention, the array of sensing devices 56 detects the edge of the flap of envelopes passing over it by detecting the edge of the flap as a step, or ledge that will define the edge profile shape of the flap of each envelope in its entire elongated form as recorded from the passing envelope.

To help understand how the edge profile shape of an envelope flap may be defined, reference may be made to U.S. Pat. No. 5,242,499 to Bergman for Nozzle Control System For Envelope Flap Moistener. In the Bergman patent the scanning and collecting of data relating to the shape of an envelope is described in detail. Comparing the present invention to the '499 reference it will become clear that the '499 reference describes the use of a number of instrumentality's that the present invention eliminates, for instance, a flap stripper blade. This prior art reference along with U.S. Pat. No. 5,098,734 to O'Dea et al are helpful in understanding how to track an envelope measure the profile of an envelope flap, and apply moisture to the flap surface by tracking that surface as the envelope moves forward. Thus it is known how to measure the height or width of an envelope flap, and how to apply a corresponding servo loop for moving and locating a moistener nozzle that will track the envelope flap, as the envelope moves along the feed path of a mailing machine. The '734 patent teaches that the moistener nozzle sprays the liquid sealant directly upon the glue flap of the envelope along the machine transport, and as the flap is mapped and measured by detecting apparatus. Both of these U.S. Patents are hereby incorporated by reference in order to help the reader understand the present invention.

Described in some detail in the preceding text, and referring to FIG. 1, and FIG. 4, envelope 26 continues along the feed path 14, being driven at a constant velocity through the nip of a first conveying section 70. A motor M3 provides rotary motion through a connected drive belt 72 to a lower driven roller 74 of the conveying section 70, and a pressure roller 76 provides the normal force required to handle the envelope. Both rollers 74 and 76 are segmented, similar to rollers 42 and 46. The segmented portion of the roller permits parts of the support deck 30 to be interlaced with the roller, thereby providing a common plane of reference for the bottom of the envelopes moving downstream.

The driven envelope 26 continues moving downstream at a constant velocity, an important feature since other functions downstream depend on a common and known point of reference in the arrival and departure of each envelope along the feed path 14. This is common requirement with mailing equipment so that timing instrumentality's in the system are able to predict following events, measuring off time as the envelope progresses forward to its downstream positions. There is an appropriate upper guide member 78 (FIG. 1) located slightly above the deck 30 and arranged to support the upper surface of the envelopes passing along the path 14.

A series of sensors, including a sensor 80, 84 and 88 that are strategically located between the roller pairs, sense the arrival and departure of leading and trailing ends of each envelope or mailpiece being processed. Sensors 80, 84, and 88 are all comprised of two components, the emitter and receiver as is well known by those skilled in the art. The sensors typically are intercepted by the passing of something, in this case the leading and trailing edges of envelopes. In order to do this, a suitable aperture is located in the support deck 30, between each emitter/receiver of sensors 80, 84 and 88 in the support member 78. This provides the typical illuminated path for the sensing of the leading and trailing edges of each envelope being conveyed along the path 14.

The sensors are connected to the microprocessor 68 to send a signal to enable the needed functions of the machine based on envelope position. The preceding description of the feeding apparatus, the separating apparatus and the envelope flap closing apparatus and the first conveying section may be rearranged if desired. For example, it is possible to place the envelope flap closing apparatus 50 in a postposition, after the first conveying section 70. This arrangement may be applicable if there is a space consideration in the design of the envelope feed path. In this case, the guide 78 will help to hold down the flap that has just been folded into its parallel relationship with the body of the envelope. The objective in either case is to have the envelope flap lie against the body of an envelope being scanned to insure that the following (downstream) scanning apparatus will be able to accurately measure the edge profile of the flap.

Scanning an Envelope Flap.

Figure 7:
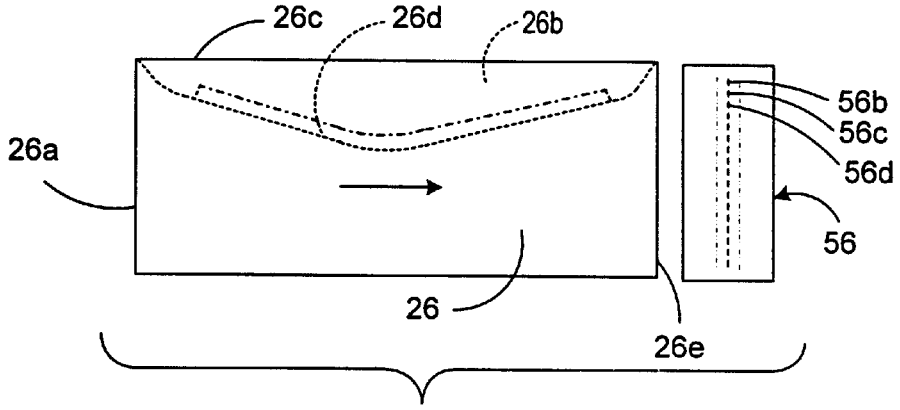
FIG. 7 is a plan view of an envelope taken along the lines of FIG. 2 without the mechanical components of the mechanism involved; the view principally showing an envelope moving towards the flap detection and scanning apparatus of the invention.
Figure 7A:
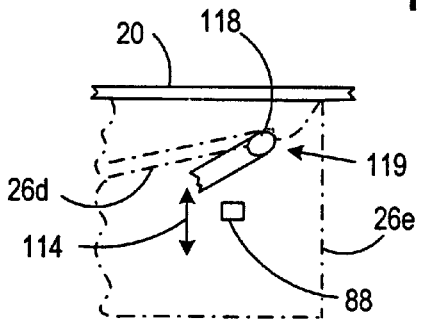
FIG. 7*a* is a partial plan view of a portion of the leading end of the envelope of FIG. 7, showing the relationship of part of the sealant application apparatus with respect to the leading end of the envelope at the moistening station..
Figure 8:
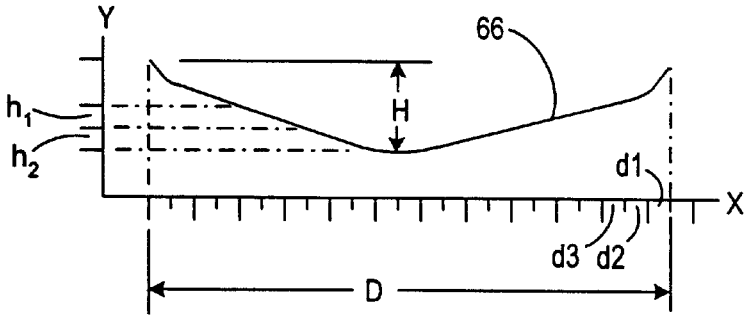
FIG. 8 is a schematic view of the envelope of FIG. 7, showing profile of the edge profile shape of the envelope flap that is scanned by the downstream scanning apparatus at right angles with respect to the forward motion of the envelope towards the moistener.

Referring now to FIG. 7, the envelope 26 is viewed without surrounding structure, as it moves towards the optical scanning window 56*a* (see FIG. 2). The elements of the array of sensing devices 56 are identified for the purpose of simplicity as an element 56*b*, 56*c*, 56*d*, and so forth. The array of sensing devices 56 is arranged in a substantially orthogonal relationship with respect to the feed path 14. When the leading edge 26*e* of the envelope passes the sensors 56*b*, 56*c* etc, a step or slope change of profile in the edge profile or profile edge shape of the flap is detected. In FIG. 8, a flap profile edge shape 66 of the envelope 26 is shown for illustrative purposes as it is recorded digitally in the form of elements Delta e-1, e-2, etc thereby representing the change in slope along the entire length of the flap 26*b*.

Figure 11:
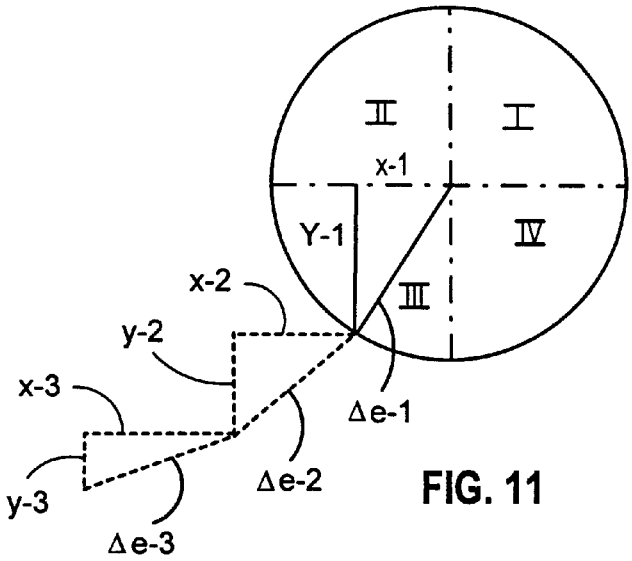
FIG. 11 is a schematic diagram representing a series of incremental dimensions of the edge profile of an envelope flap as scanned by the detection apparatus.

This change in slope represents the edge profile shape 26*d* of the flap 26*b*. This may be further explained by referring to FIG. 11, in which the 4 quadrants of a circle are represented. In the present case the change in slope for the flap is defined by a vector (Delta) Δe-1, and vector (Delta) Δe-2 measured from the end of vector Δe-1. The initial vector Δe-1 may be interpreted or represented as a finite radial dimension determined by the resultant vector, hypotenuse, or radial dimension as measured from the center of a circle. Otherwise spoken, the vector Δe-1 may be defined representing an initial and minute portion of the edge of a profile shape of an envelope flap. This may alternatively be defined as a portion of a profile edge shape element. When added to all other vectors, the portion will accumulatively capture the entire flap edge profile in the referred progression of envelope 26.

Figure 12:
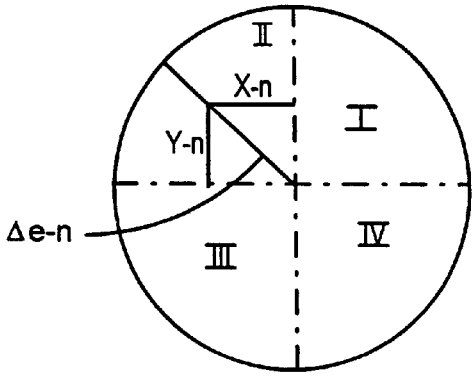
FIG. 12 is another schematic diagram representing a different area of the edge of the envelope flap and an incremental dimension of the edge profile of that flap as scanned by the detection apparatus.

FIG. 12 demonstrates the scanning of another portion of the scanned edge profile of envelope 26 except that the array of sensing devices 56 is seeing a positive slope of the edge profile, such as that defined by the trailing second half of the envelope 26. In FIG. 12, a vector Δe-n is identified, a positive slope portion of the profile edge shape of envelope 26. Vector Δe-n is representative of the continuing capture of the profile edge shape of the envelope 26 as the envelope 26 moves across the array of sensing devices 56. Additional readings of the edge of an envelope edge profile would provide the same slope, a different slope, or a slope that would be defined in another part of the quadrant as being positive, or negative as is well known in Calculus and general mathematics. The element vector Δe-1, and all that follow such as Δe-2. Δe-3 is each recorded in a table 90 (see FIG. 9) within the controller 71.

The chart in FIG. 8 represents a measurement of the height of an envelope flap that may be defined as "H". "H" is divided into an increment h1, h2 etc as measured along the y ordinate. Similarly, the chart also depicts a length of an envelope flap that may be defined as "D". "D" is broken into an increment d1, d2 etc as measured along the x ordinate of the chart. The V shaped profile in the chart is representative of the flap 26*b* profile edge shape of envelope 26. Corresponding segments of each minute part of the shape are recorded when scanned by the array of sensing devices 56 for processing as height and length segments and part of the total edge profile and shape of the flap of envelope 26. The vectors described above all relate to the increments defined above in terms of "d" and "h" since any resultant R of a triangle defined by the "d" and "h" terms are actually the vectors. In a further definition that may be applied for other shaped flaps on envelopes, any flat portion of an envelope flap oriented horizontally (such.as a square flap) and any vertical side on an envelope flap may be defined as follows: Such envelopes may be aligned with the x-axis of the chart in FIG. 8 and may be defined having a x ordinate dimension (in increments of "d") and any vertical portion of an envelope flap edge profile is then defined as a y ordinate dimension (in increments of "h").

Each envelope following the preceding envelope that is moving through the transport path 14 will be recorded in similar fashion. Table 90 (FIG. 9) in the microprocessor 68 is capable of recording the entire edge profile shape of each subsequent (following) envelope passing over the optical assembly 60. Each envelope processed will have its own identity, and -address within the table 90, for future reference downstream in the moistening process.

When a trailing edge 26*d* of envelope 26 passes the array of sensing devices 56, a trigger in the microprocessor 68 will be reset, enabling the set-up of the system for reception of another flap profile. Envelopes are manufactured according to specific guidelines, as recommended by cooperative manufacturing criteria set up by the envelope companies such as Moore Paper Company, Weyerhaeuser Inc. and others. Envelopes and their associated flaps are manufactured by commercial apparatus and defined in many different shapes. A common flap profile is a v, another is trapezoidal, and another is square. Some flaps are rounded, in combination with the previous mentioned shapes. The present invention will scan all of these shapes, and define each flap edge profile as described above. The profiles as stored will be used in the actual moistening process that will now be described as envelope 26 continues advancing downstream along path 14.

The Flap Moistening Process.

Referring to FIGS. 1 and 2, Envelope 26 advances forward to a liquid applicator apparatus 100, which also may be characterized as a liquid sealant application device a moistening device, or a liquid sealing application apparatus. The liquid applicator 100 has driving and liquid supplying devices including a nozzle 118 (also characterized as a fluid-spraying device). Nozzle 118 is suspended in a structure 101 that is suspended from a rod 124. The Nozzle 118 is attached to a transport apparatus 120 (FIG. 2), that includes a motor and associated mechanisms attached to the liquid applicator 100. The rod 124 is rigidly attached to the machine structure as will be understood by those skilled in the art. The rod 124 provides a stable platform and accurate vertical and horizontal location for the liquid applicator 100 and structure 101. The structure 101 has suitable linear bearings (not shown) included in its frame-like structure. The bearings permit structure 101 and all attached hardware including the attached nozzle 118 to glide reciprocally along the rod 124 in a path 114. The liquid applicator 100 is arranged to move at right angles with respect to the feed path 14. The right angle direction may be modified to a slightly different orientation to accommodate other mechanism in the area, or to provide a slightly canted application path for the nozzle 18. The reciprocal motion is produced by a driving assembly attached to a motor M4 and associated components to be described next.

Referring to FIG. 2, the motor M4 is mounted to the machine structure of mailing machine 10 (as will be understood by those skilled in the art) along with a cable support pulley 130, both mounted to fixed structure of the machine frame. There is a cable 134. suspended and engaged with the pulley 130 and a pulley 138 attached to the shaft of motor M4. The cable 134 is fixed to the liquid applicator 100 so that rotation of the motor M4 causes linear reciprocal motion of the liquid applicator 100 and the associated structure 101 with attached nozzle 118 in the path 114. There is appropriate sensing devices (not shown) mounted in the machine structure that detect the exact position of the nozzle 118, as carried by the liquid applicator 100. For the purposes of this specification, those sensing elements are not shown, but will be understood, as they are typical of those that are applied to for example, copier products, and associated scanning devices in which the exact position of scanning optical assemblies in transit is always known.

Figure 6:
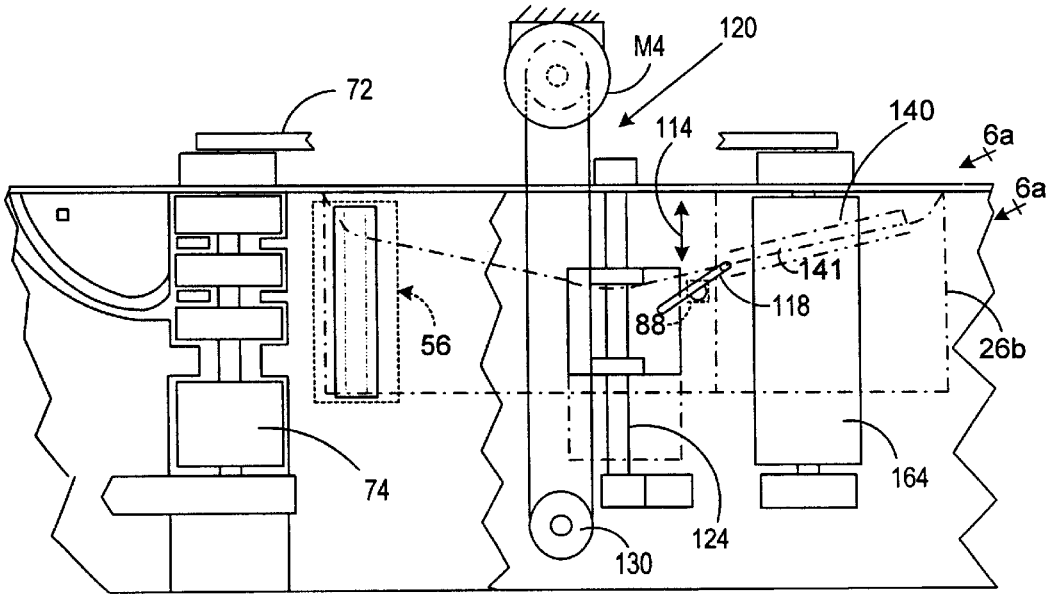
FIG. 6 is a view taken along the same lines as FIG. 5, showing the envelope moving forward towards the sealing apparatus, while the sealant application apparatus moves along a path to deposit sealant along a path and area adjacent and overlapping the edge profile of the envelope on the flap side of the envelope.
Figure 6A:
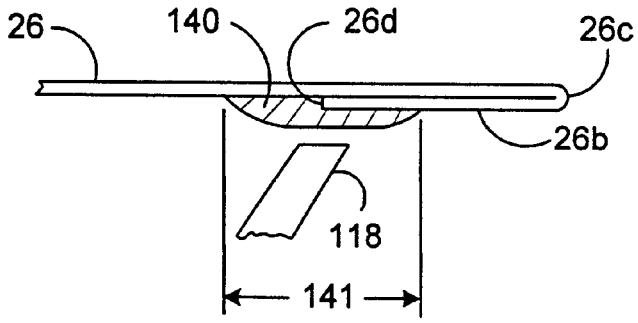
FIG. 6*a* is a partial end view taken from FIG. 6, showing a band-like area of liquid sealant being applied to a band-like surface area encompassing the envelope flap edge and a portion of the outside envelope flap.
Figure 7B:
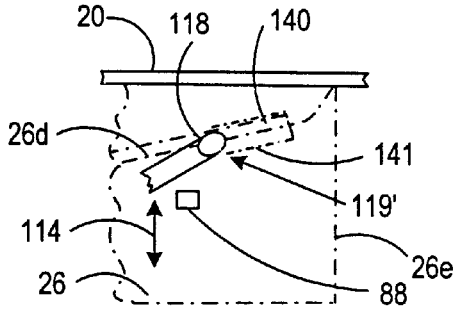
FIG. 7*b* is a partial plan view taken along the same lines as FIG. 7*a*, showing the envelope an increment advanced along the feed path past the moistening station, and the sealant applicator moving at right angles away from the machine registration wall.
Figure 7C:
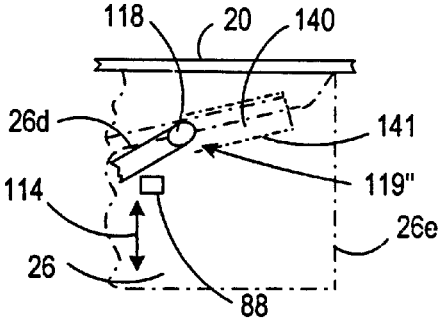
FIG. 7*c* is another partial plan view taken along the same lines as FIGS. 7*a*, and 7*b* showing the envelope a further distance moved along the envelope feed path, past the moistening station, while the sealant applicator moves further yet away from the machine registration wall.

Referring now to FIG. 5, FIG. 6, FIG. 7*a*, and FIG. 9, the leading edge 26*e* of envelope 26 is shown directly beneath the nozzle 118. The leading end 26*e* of envelope 26 is detected by sensor 88 thereby causing a signal 128 that triggers a servo loop associated with the control system 68. At this time, motion of the nozzle 118 is initiated, and Motor M4 causes the nozzle to move outward, incrementally along path 114 away from the registration wall 20. At this time, the progressive movement of the nozzle 118 may be seen in the partial views FIG. 7*b* and 7*c*, as distinguished from the initial starting position represented in FIG. 7*c*. The movement of the nozzle 118 is commensurate with the velocity of the envelope 26 so that a band-like volume 140 (See FIG. 6*a*) of sealing agent is squirted or sprayed on a band-like surface area 141 defined by the profile edge shape 66 of envelope 26. The band-like volume 140 of sealant may be applied to the area immediately adjacent to the profile edge shape of the envelope (along edge 26*d*), or it may overlap the edge 26*d* and be partly on the outside portion of the flap that frames edge 26*d* as seen in FIG. 6*a*. This way of applying the sealant may be considered as an indirect method of applying the sealant to the envelope flap, since there is not any direct contact of the applying apparatus to the envelope flap or associated components of the flap.

Referring to FIG. 8, the sealant is applied for each incremental forward motion of envelope 26 and correspondingly, there is an incremental movement of the nozzle 118 along path 114 from a home position 119 to a position 119', a following position 119" and so forth. While this occurs, there is a constant deposit of sealant previously defined as the band-like volume 140. The structure 101 and associated nozzle 118 move along the path 114 in such motion as to deposit the sealant in the area 141 in a constant, uninterrupted manner. The area 141 is a representative profile shaped band that overlies a parallel path of the profile edge shape defined by envelope edge 26*d*. The area 141 is sufficiently large enough to encompass a surface area that overlaps the flap edge 26*d* for envelope 26. The profile edge shape previously defined in the scanning portion of the feeding cycle of envelope 26 is extracted from the table 90.

There are other types of liquid application devices that can deliver a bead-like volume of sealant in place of the nozzle device just described. In such a case, application of a continuous stream of beads along the same path defining the flap profile shape would provide enough sealant as well. In either case, the liquid sealant will migrate to the glued portion of the flap. Beads of sealant will similarly migrate to the glued portion of the flap.

An envelope following envelope 26 is mapped in the same fashion, that next envelope having a similar flap shape, or some alternate shape. In all cases, the sealant is deposited along the edge area of the flap defined and recorded as a unique profile edge shape. It will be understood by those skilled in the art, the area 141 as defined may be made larger, smaller, and could overlap a small portion of the outside portion of an envelope flap to ensure that the sealant covers the immediate area. This flexibility will provide a positive amount of sealant that will migrate by capillary action under the outside flap to the glue portion of the envelope.

The deposit of the sealant upon the area 140 is constant. A volume of $1/10_{th}$ CC of sealant is applied per lineal inch of glued flap area on the average size envelope. If, the envelope is of extraordinary size, it is possible that a greater volume of sealant is required. By the same reasoning, a lesser amount may be appropriate for a smaller size flap and supporting glue surface. Additional sensing devices (not shown) would be able to enable the delivery of an increased amount of sealant to correspond with a potential larger glue area of a given envelope. Another approach to this is to have a selectable range of glue surface on the machine control, so that an appropriate algorithm would automatically compensate for the size of the glue coating. A setting of minimum, medium or large would automatically adjust the volume of sealant being delivered in this case.

The present embodiment illustrates the sealant delivery mechanism including a peristaltic pump 150, (FIG. 1), located within a sealant reservoir tank 154. Both the pump 150 and tank 154 are mounted in the supporting frame structure of the machine 10. There is a flexible supply tube 152 connected to the pump 150, and the nozzle 118, so that the nozzle will be supplied with liquid as it tracks the deposit area 140 in its motion along path 114. The pump 150 is a peristaltic type, but may be a piston design, or other fluid pumping device depending on space available and desired output for the moistening task. Alternate ways of presenting the sealant to the area defined adjacent to the edge flap profile are possible. For example, the nozzle may be fixed to the structure, but mounted to rotate in a direction that accomplishes the same incremental step for a corresponding advancing step on the envelope. This will be understood by those skilled in the art as an alternate way to deliver the sealant to the intended envelope surface, and as such is similar to the linear direction defined with the present invention. In addition, the sealant may be a special formula defined by attributes that enable positive sealing of flaps, or it may be water. The nozzle and associated mechanism that delivers the sealant may be an alternate positive pumping device, such as that commercially available for use in fish tanks, or it may be one formed out of commercially available peristaltic pump mechanisms. The supply of sealant is maintained by a supply tank 159 connected to the reservoir 154, by apparatus of a suitable chicken feeder, or similar device, that refills the reservoir when it drops to a predetermined level. Supplying liquid, this way is well known in the field.

The deposit of sealant in a stream, or band-like volume as previously defined is sufficient to enable the deposited sealant to move by natural capillary action along and under the edge 26*d* of the flap 26*b* of envelope 26. It has been discovered that this is the most effective way to provide sealant to the covered glued surface of envelope flaps without opening the flap. The technique described in the present invention also minimizes the amount of sealant applied to the outside surface of the flap without wetting the whole major outside surface of the flap. The present invention is intended to supply such liquid sealant only to a restricted and minimal area of the outside of the flap portion of envelopes.

The sealant application as applied to the flaps in a localized area on the flap side of a moving envelope may be described in a number of different terms. Terms such as examples are a band-like volume, a band, a seam, a series of drops forming a band, a beaded series of drops, a wiped surface area, or other appropriate definition are all applicable in describing the application of the sealant. Mentioned previously, such volumes of sealant as applied may lie adjacent to the profile edge shape of the flap, or be overlapping in nature with a portion adjacent to the edge, or on the side of the edge. This application process is intended to insure there is enough sealant to be available for the capillary process. To exemplify this invention, and to illustrate further how the invention may be carried out, other sealant applying devices will be now be described.

Another consideration in respect to the foregoing embodiment of the invention as described is placement of the envelope closing apparatus. It is possible to place the envelope closing apparatus downstream of the first conveying or separating apparatus as described in the preceding text. This apparatus that the overall footprint of the machine or envelope-processing machine will be smaller. The only requirement for re-locating the envelope closing apparatus is that there is a conveying apparatus someplace upstream in order to propel the envelopes or mail along towards the scanning apparatus. Various other schemes including a conveyor belt, rollers, or a vacuum feeding belt could be substituted anywhere along the feed path in order to accomplish getting the envelopes and mail to feed along the described feed path.

In further consideration of the present invention, there is a minimum of sealant applied in volume, unlike the prior art where the entire inside flap of the envelope may be wetted. In standard flap moistening devices, the sealant is typically applied across a major portion of the inside of each flap, which can cause problems with excess liquid material in this area when the envelope is transported further along the mailing machine feed path. The present invention has a solution for removing any possible excess amount of liquid sealant, and this will be described towards the end of this specification.

Alternate Embodiment of the Present Invention.

Figure 13:
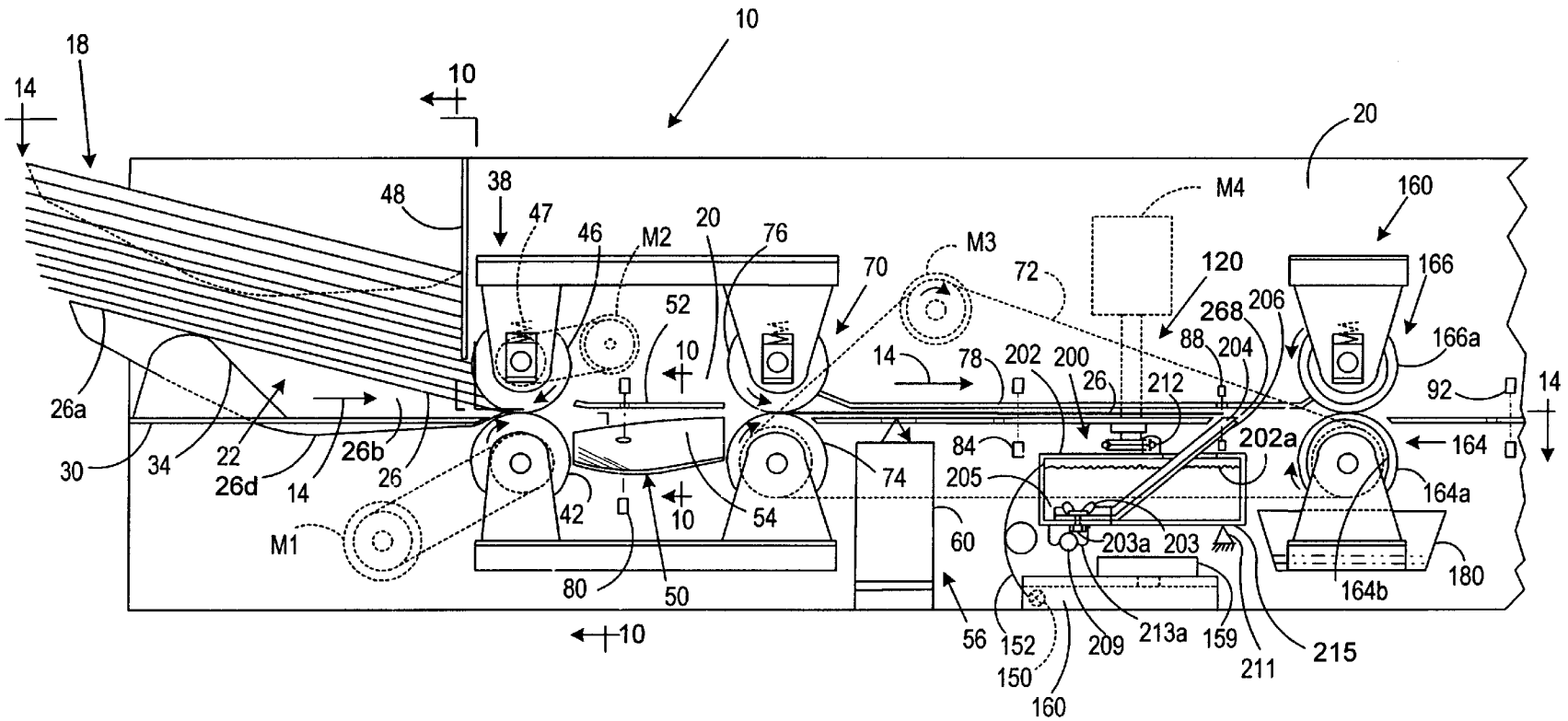
FIG. 13 is an elevation view taken along the same lines as FIG. 1, illustrating an alternate embodiment of the present invention utilizing a wick applicator.

Another embodiment of the present invention is illustrated in FIG. 13, which is the same as FIG. 1 with the exception of the substitution of an alternate liquid applicator 200. The liquid applicator 200 is shown in FIG. 13 being structurally integrated with a s sealant reservoir 202. The embodiment illustrated in FIG. 3 is representative of a transfer moistening apparatus and transfer device, which may also be characterized as a contact device, wiping device or coating device.

FIG. 3 is partially broken away in the area of the reservoir 202 in order to show the interior components, and a supply of liquid sealing agent 202*a*. The reservoir 202 is capable of holding sufficient liquid sealant material for the purpose of supplying an internally mounted fluid transfer member 204 (otherwise known as a wicking device) with sealant. Member 204 is formed of a material such as that described in U.S. Pat. No. 3,781,270 to Reid et al, which is hereby incorporated by reference. The material is synthetic, and is napped for applying sealant. This material is identified under the trade names Dynel and Nylon. Another material that may be used is felt. The use of felt is described in U.S. Pat. No. 3,811,407, in which the felt is used as a wicking member for moistening envelopes. Either material will provide sufficient sealant via capillary action for the purposes of satisfactory flap moistening. Additionally there are many other materials suitable for this purpose, such as open cell foam. The objective in selecting a suitable material will be the ability of transfer of liquid in a capillary action process, and a material that will withstand wear caused by processing of the envelope material passing over it. Dupont manufactures material such as this, and other well-known companies.

Figure 14:
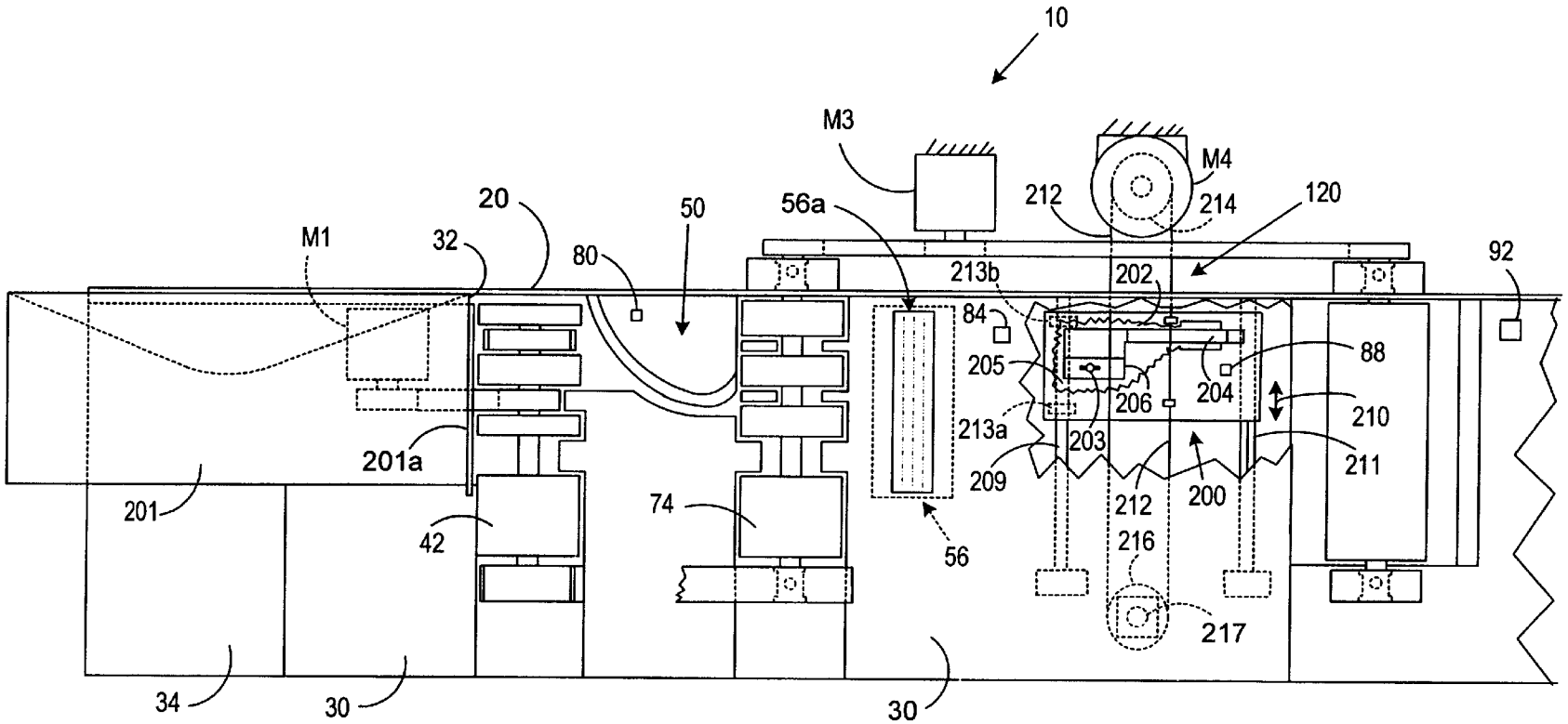
FIG. 14 is a plan view of the embodiment shown in FIG. 13, showing the structure of the wick-moistener device in the envelope-processing machine.

FIG. 13 shows the general arrangement of the transfer member 204 as it sits within a chamber 205 comprising the well of the reservoir 202. Referring also to FIG. 14, the member 204 is shown as it is satisfactorily fastened to the bottom of reservoir 202 by a wing screw 203 and a nut 203a. The member 204 is thus anchored against possible displacement during the movement of the liquid applicator 200 or as a result of contact with the moving envelope material. A backing member 206 formed out of beryllium copper or other suitable equivalent corrosion resistant material supports the member 204. Member 206 is resilient (beryllium copper and phosphor bronze are materials that flat springs can be manufactured from) to permit it, and the member 204 to yield downwards when a fatter or thicker envelope passes by during the moistening process.

FIG. 14 shows the shape of the transfer member 204 as being formed in an L. The shape may be in any configuration that will satisfactorily lie at the bottom of the reservoir 202. Sufficient sealant for moistening will be drawn upwards into member 204 by capillary action, and will wipe the envelope flap area while the envelope moves past it as is described now in the following text. Member 204 will wipe, or transfer the sealant at a transfer point 268 (FIG. 13) when the envelope 201 approaches that transport area in the feed path 14; and will be supported by the member 78 when a slight pressure of the wicking device 204 engages the envelope.

In addition, it will be recognized that the cross sectional shape of the transfer member is designed to transfer the maximum amount of sealant in the capillary action process. While for the purposes of this description, a rectangular shape is shown in the drawings, (FIG. 14), it will be recognized a semicircular shape, or a square shaped cross section can work as well. It is even possible to place a bristle brush in the vicinity of the member 204; the bristles being integrated with member 204 as the need may be to help wipe the area of the envelope to be sealed.

Figure 14A:
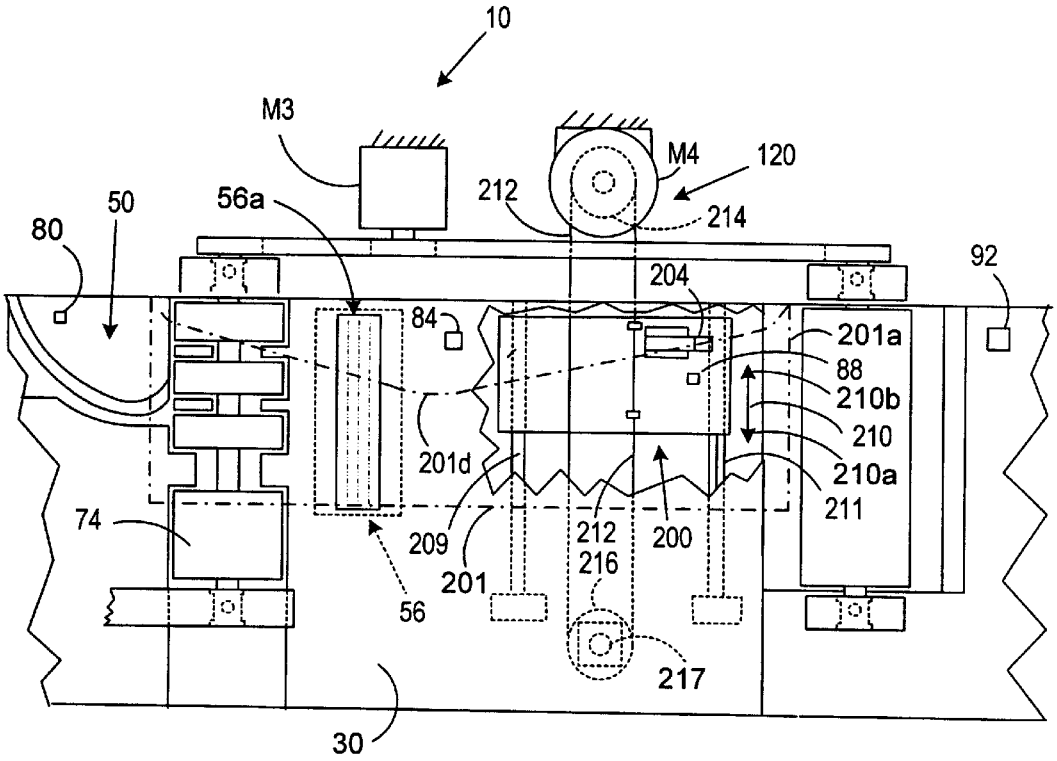
FIG. 14*a* is a partial plan view taken from FIG. 14, in which a moistening apparatus is shown at its initial home position with an envelope passing beneath it.

The shape, or edge profile of the flap of any envelope passing through the system is identified as is described in the preceding text associated with FIG. 7, and with the use of the array of sensing devices 56 and associated electronics previously described in the present specification. Referring to FIG. 14*a*, an envelope 201 passes through the same sensors (80,84 & 88) and associated apparatus previously described with reference to the liquid applicator 100. Similarly a flap profile (in this case for envelope 201) is registered in the described control system 68, and a leading edge 201*a* of envelope 201 enables sensor 88. (The lead edge 201*a* of envelope 201 is shown having moved slightly past sensor 88.) At this time, the liquid applicator 200 will initiate motion in a bi-directional motion 210 (FIG. 14*a*). The motion 210 may be broken down into an outward motion 210*a*, and a return motion 210*b*. In FIGS. 14, and 14*a*, the liquid applicator 200 is shown at the starting position or initial home position, adjacent to the registration wall 20.

The liquid applicator 200 is supported and driven in a similar fashion as the previously discussed liquid applicator 100 (the transport apparatus 120 is the same). There is a support rod 209, and a support rail 211, both satisfactorily secured to the frames of the machine structure of mailing machine 10 (this will be understood by those skilled in the art). The liquid applicator 200 has appropriate lug appendages 213*a* (FIG. 13, FIG. 14) that sit on top of the rod 209, while the rail 211 supports the liquid applicator 200 on a bottom surface 215 of the sealant reservoir 202. The rod 209 and rail 211 support and guide the liquid applicator 200 during its reciprocating motion 210.

Motor M4 provides the liquid applicator 200 with reciprocating (bi-directional) motion 210 with the use of a connecting drive cable 212, (FIG. 13, FIG. 14) mounted to a pulley 214 on Motor M4, and a fixed rotatable cable support pulley 216. Pulley 216 is rotatably mounted on a suitable fixed stud 217 that is appropriately secured to an appropriate portion of the structure of machine 10 (not shown). The cable 212 is secured to the reservoir 202 of the liquid applicator 200 with appropriate clamps (not shown) so that the liquid applicator 200 will glide reciprocally in the reciprocating motion 210. This motion is directed by the control system 68 in order to meet the flap shape profile defined previously by the array of sensing devices 56, and all previously associated electronics.

Figure 6B:
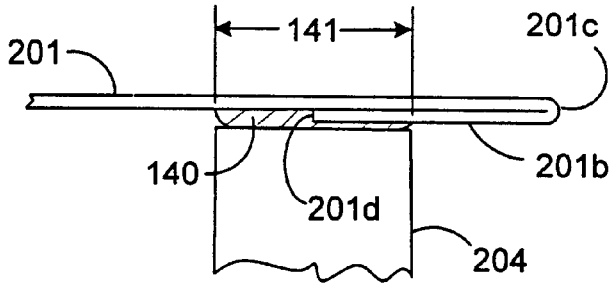
FIG. 6*b* is a view similar to FIG. 6*a*, showing an alternative embodiment utilizing a wicking member for applying the band-like area of liquid sealant to a band-like surface area encompassing the envelope flap edge and a portion of the outside envelope flap.

The transfer member 204 in this embodiment is flat, and wide enough to engage the seam edge of the envelope. The member also overlaps the seam edge area in a swath wide enough to insure enough sealant will be available for the capillary transfer to the gummed flap area. Referring to FIG. 6*b*, the member 204 is seen as it engages a band-like surface area 141 (see FIG. 6*a*) defined by the profile edge shape of envelope 201 along flap edge 201*d*. The band like area of sealant (see FIG. 6*a*) in this case is wiped on the area 141 up to and over the envelope flap 201*b* similarly as defined in reference to that described for the liquid applicator 100 (FIG. 6*a*).

Figure 14B:
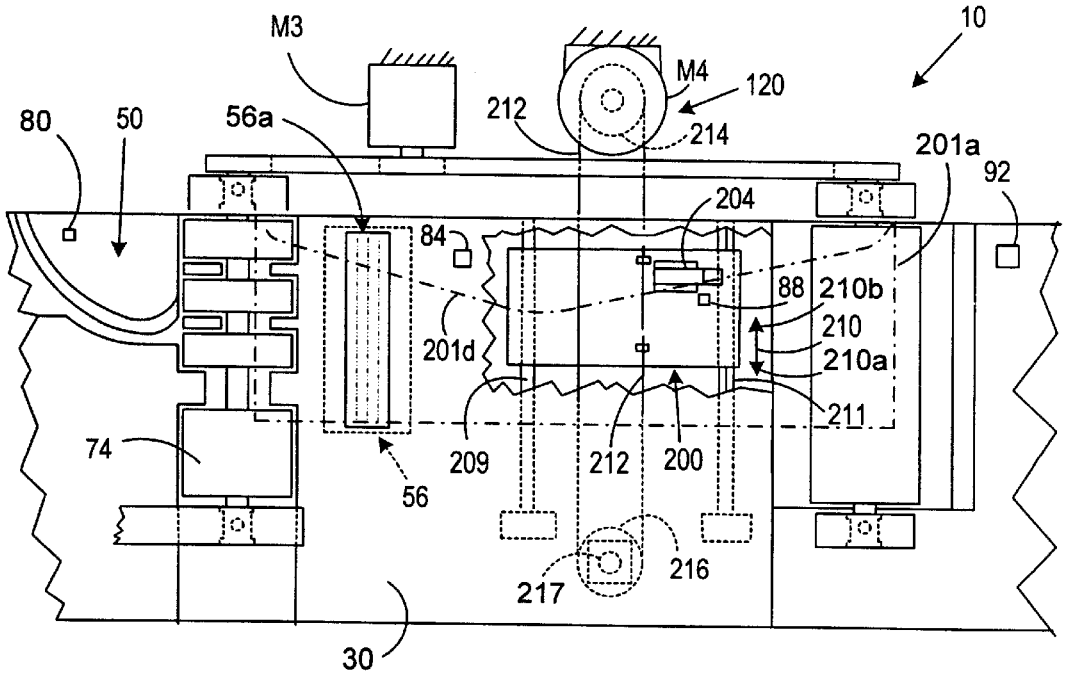
FIG. 14*b* is a partial plan view taken along the same lines as FIG. 14*b*, showing an envelope having moved downstream with the moistening device having moved an increment away from its home position.

In FIG. 14*b*, the envelope 201 has moved further downstream, and the liquid applicator 200 has moved further outwards along the path 210*a*, following the predetermined track that is stored in the controller 71 for applying the liquid sealant along the band-like surface area 141 such as that previously described for the liquid applicator 100 (FIG. 6*a*). The band-like sealant surface area 141, and overlap as it would be applied to the envelope profile edge using the liquid applicator 200 is similar to that described previously with the embodiment utilizing the liquid applicator 100 (see FIG. 6*b*). When the liquid applicator 200 reaches the farthest outboard point that will satisfy the flap edge profile previously defined by the controller 71, it returns to the home position adjacent to the wall 20 until the next envelope comes along.

Another Alternate Embodiment for the Present Invention.

Figure 15:
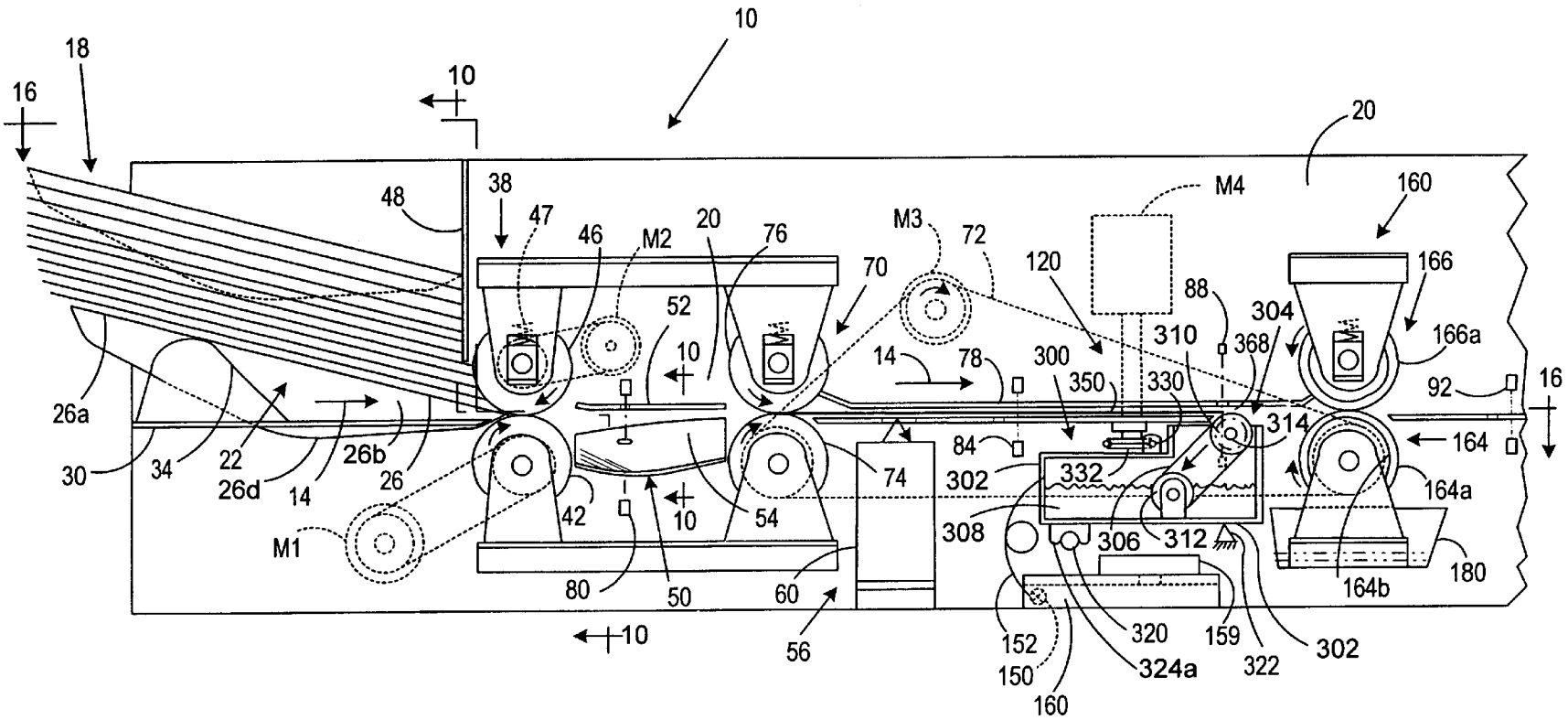
FIG. 15 is an elevation view taken along the same lines as FIG. 1, showing another embodiment of the present invention utilizing a belt-moistening device.

Another embodiment of the present invention is illustrated in FIG. 15, which is the same as FIG. 1 with the exception of the substitution of an alternate liquid applicator 300. The liquid applicator 300 is shown in FIG. 15 being structurally integrated with a sealant reservoir 302. The reservoir 302 is basically a liquid holding container with sides, and sufficient cover to contain the sealant held inside (Details of the box-like structure will be understood by those skilled in the art). Thus, the reservoir 302 is capable of holding sufficient liquid sealant material for the purpose of supplying an internally mounted fluid transfer belt assembly 304 (otherwise known as a fluid transfer device). The belt assembly 304 includes a belt transfer device 306. The belt transfer device 306 is formed of a material such as that described in U.S. Pat. No. 3,781,270 to Reid et al, previously mentioned and incorporated by reference. The material as described in that reference is synthetic, and is napped for applying sealant. This material is identified under the trade names Dynel and Nylon for the purposes of satisfactory flap moistening. Additionally there are many other materials that a belt may be manufactured from such as open cell foam. The belted material is satisfactory for transferring the sealant from a reservoir 308, which holds the sealant. In this case, the belted material will carry the sealant upward to the transfer area where it will meet the oncoming envelopes. Once the sealant is applied to the envelope, the capillary action carries the sealant into and under the flap of the envelope passing overhead.

Figure 16:
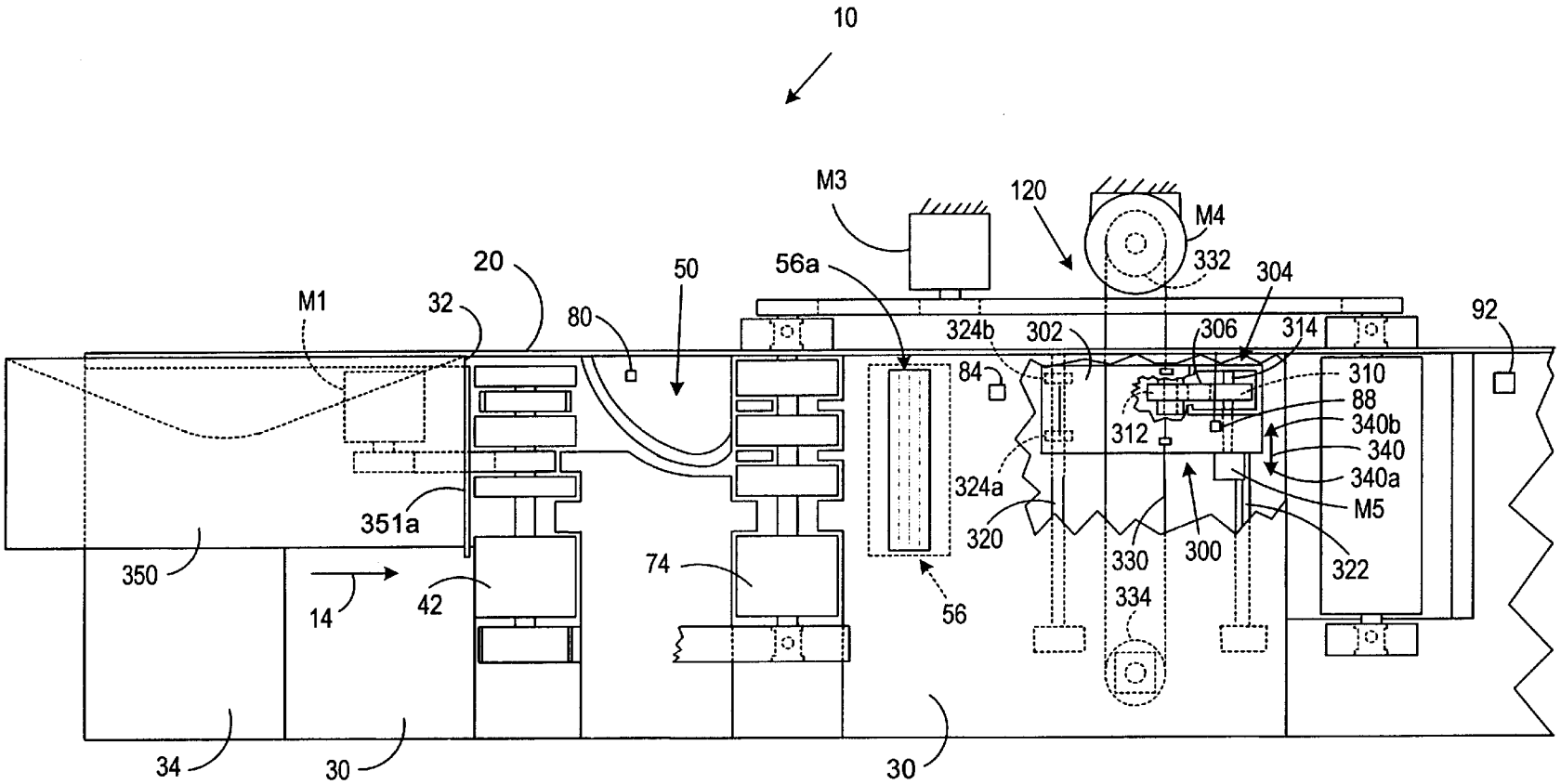
FIG. 16 is a plan view of the embodiment shown in FIG. 15, showing the structure of the belt-moistening device in the envelope-processing machine.

The liquid applicator 300 is mounted in a similar fashion to that described for the liquid applicator 100 and 200. For example, the driving motor M4 (FIG. 16) and accompanying support for that motor M4 is the same as previously described in this specification (the transport apparatus 120 is the same). There is also a belt driving motor M5 (FIG. 16) in the structure of the reservoir 302. Details of how the motor M5 is mounted is not described or shown in the present specification, suffice it to say that the motor is mounted sufficiently to permit rotation of the belt transfer device 306, but not the motor M5. In FIG. 15 and FIG. 16 the sealant reservoir 302 is viewed as it is much the same for accomodating the aforementioned moistening the liquid applicator 100 and 200. The reservoir 302 is illustrated with the belt transfer device 306 appropriately mounted for moving against (CCW in FIG. 15) the on-coming flap surfaces of the envelopes to be moistened. There are appropriate mounting structures and raised projections formed as part of the reservoir 302 that suspend the pulleys, with mounting shafts (as will be understood by those skilled in the art). A driving pulley 310 and an idler pulley 312 supports the belt transfer device 306. The driving pulley 310 is fixed to a drive shaft 314 as previously mentioned. A motor M5 is attached to the outer structural wall of reservoir 302 and is directly attached to the drive shaft 314.

The liquid applicator 300 is supported by a fixed shaft 320, and a rail 322, both mounted to the structure of the machine 10 as will be understood by those skilled in the art. There is a pair of lug elements 324*a* and 324*b* (FIG. 15, FIG. 16) attached to the reservoir 302 for engagement with the fixed shaft 320. A bottom surface of the reservoir 302 is supported by the rail 322 (understood by those skilled in the art). This is similar to the previously described reservoir in the liquid applicator 100 and 200. There is a cable 330 supported by a pulley 332 mounted on the motor M4, and a fixed rotatable pulley 334 mounted to the machine 10 structure on a stud 335. The cable 330 is suitably fastened to the body of the reservoir 302, and is reciprocally driven in a bi-directional path 340. The assembly moves outwardly in a direction 340*a*, and back in a direction 340*b* to the home position previously described for the liquid applicator 100 and 200, (the registration wall 20).

Figure 16A:
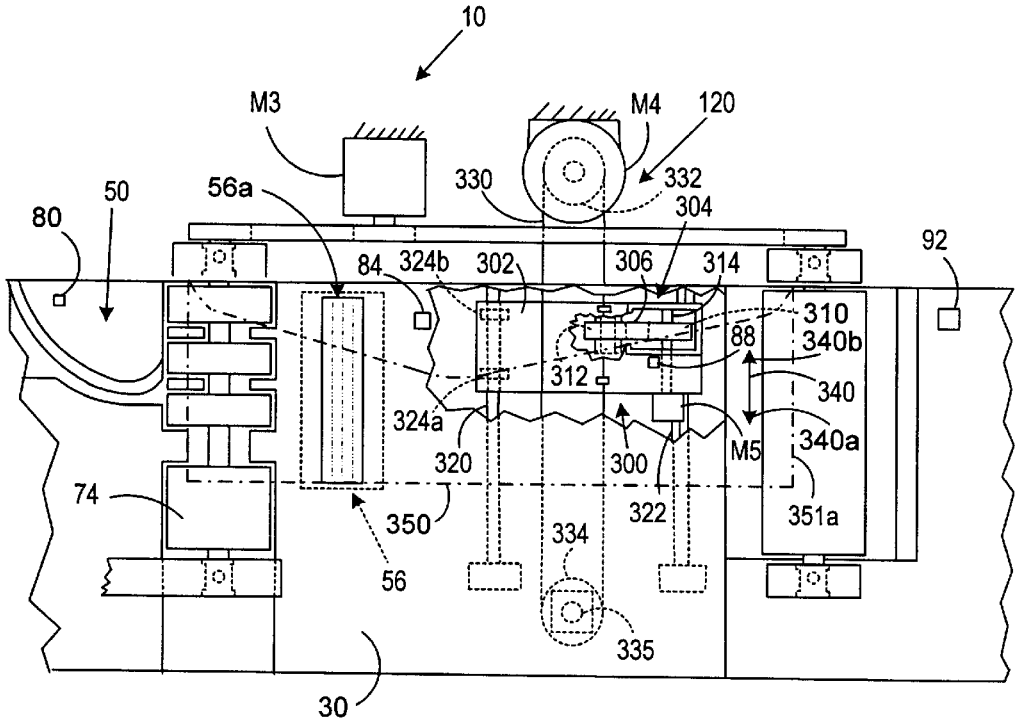
FIG. 16*a* is a plan view of the embodiment shown in FIG. 16, showing an envelope having passed the sensor that triggers the moistening function.
Figure 16B:
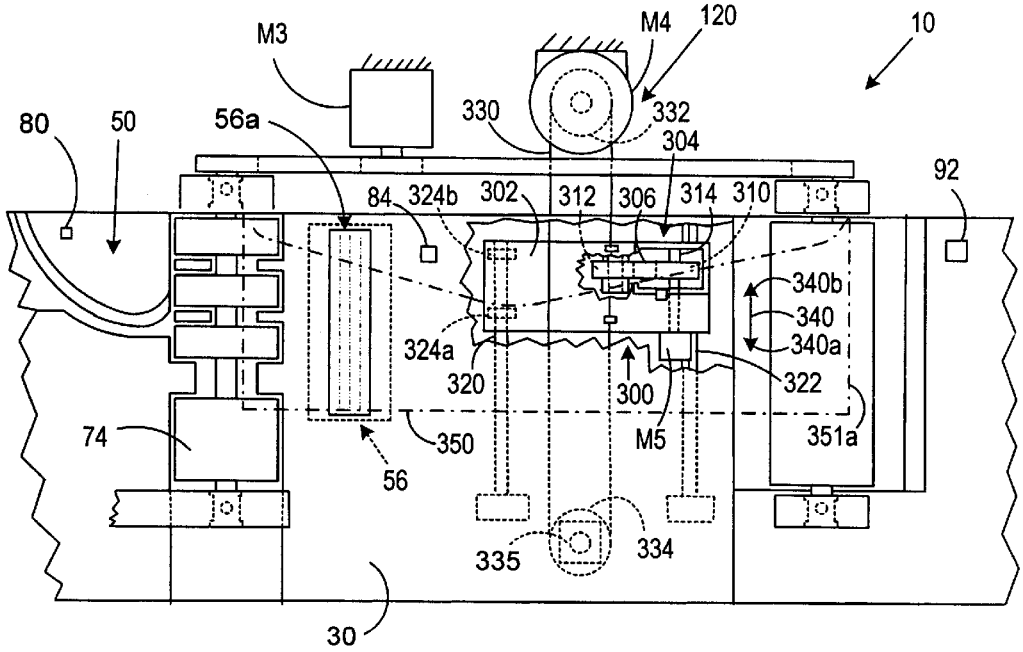
FIG. 16*b* is a plan view taken along the same lines as FIG. 16*a*, showing the envelope in a further downstream position, while the belt moistening device has moved outward away from the registration wall.

Referring back to FIG. 16, an envelope 350 passes through the same series of sensors, 80–88 and feeding apparatus previously described and associated with path 14. Once again, a flap profile is registered in the described control system 68, and a leading edge 351*a* of envelope 350 reaches sensor 88 to initiate the transfer of sealant and the following moistening process to the flap of that envelope. At this time, the liquid applicator 300 will initiate motion in the bi-directional motion 340. The liquid applicator 300 moves along the outward direction 340*a*, and inward along direction 340*b*. FIG. 16 and FIG. 16*a* shows the liquid applicator 300 in the initial starting position, adjacent to the registration wall 20.

Referring back to FIG. 16, the details of how the liquid applicator 300 is mounted and guided as the belt transfer device 306 is shown slightly inclined with one end (the lower end) immersed in the sealant within the reservoir 302. The inclination of the belt transfer device 306 is satisfactory to enable the sealant to be transported upwards towards a transfer point 368 where the overlying guide member 78 supports the upper surface of the envelope 350 in its motion past the transfer point 368 (FIG. 15). The liquid applicator 300, and the belt transfer device 306 may also be termed a transfer device, a coating device, a wiping device, or a contact device, all meaning there is physical contact between the envelope and the belt transfer device 306. The guide 78 also resists the pressure of the belt transfer device 306 as it pushes lightly against the envelope 350. The belt transfer device 306 is thick enough to absorb the variations expected in the envelopes being processed. The belt transfer device 306 is manufactured of a material that is resilient (felt) by nature, and can be of different cross sectional shape, and width as long as sufficient sealant is carried upwards to the transfer point 368.

Figure 6C:
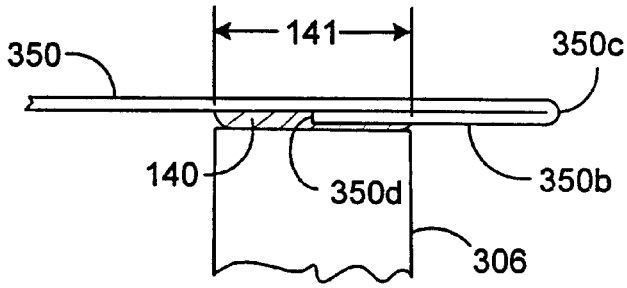
FIG. 6*c* is a view similar to FIG. 6*a* showing another embodiment employing a moving belt for applying the band-like area of liquid sealant to a band-like surface area encompassing the envelope flap edge and a portion of the outside envelope flap.

The belt transfer device 306 in this embodiment has a flat outside surface, and is wide enough to engage and overlap the edge of the envelope flap. In FIG. 17, the envelope 350 is seen as it has progressed towards the liquid applicator 300. Referring to FIG. 6*c* the belt transfer device 306 overlaps a flap edge 350*d* of an envelope flap 350*b* in a swath wide enough to insure enough sealant will be available for the capillary transfer to the gummed flap portion of the envelope 350.

Similar to the prior embodiments, an envelope flap edge 350*d*, (FIG. 6*c*) and the area adjacent to that is covered by the band-like area of sealant 140 that is conveyed in to the transfer point 368. The sealant 140 is applied to the area 141 previously described and referenced to FIG. 6*a*. Similar to the other embodiments described in the present specification, the liquid applicator 300 will initially move away from the registration wall 20 after a leading end 350*e* of the envelope 350 passes the sensor 88. The functional process after the initialization of the signal that the envelope 350 has arrived is exactly the same as previously described with reference to the other embodiments. The liquid applicator 300 returns to its home position after the moistening process enabled by the belt transfer device 306 has moved outwards along path 340*a* to the limit determined by the flap edge profile defined by the flap profile sensor apparatus 58,and associated electronics previously described. The liquid applicator 300 then moves along a path 340*b* to the home position adjacent to the registration wall 20.

The Sealing Process.

Referring back to FIG. 1, there is a second conveying section 160, with a lower roller 164 rotatably mounted similar to that of the previously described rollers 42 and 74 in the first conveying section 70. The second conveying section 160 may be considered the output conveying section of the envelope feed path 14. Roller 164 is connectively driven through appropriate pulleys to the drive member 72, which is powered by motor M3. The roller 164 is formed of a 40 to 50 durometer elastomeric sleeve covering 164*a* over an inner plastic support roller 164*b*, which is the main support and journal roller in this case. A biased roller 166 formed of a sleeve covering 166*a*, formed of urethane elastomer of 40 to 50 durometer. Roller 166 is biased against roller 164 with suitable spring members 47. Depending upon the type of material the envelopes are manufactured from, it may be possible to use a higher durometer sleeve covering for one or both rollers in the conveying section 160. A higher durometer such as 60–70 may yield better results with certain envelope stock having different surface finishes.

Both rollers of the conveying section 160 are solid and completely covered along the transport surface with the aforementioned sleeves. There are no segments along the transport surface of the conveying section 160, so as to provide a solid surface for squeezing excess liquid sealant from the flap area of envelopes. The roller 166 is journaled in appropriate bearings, and support structure permitting automatic upward adjustment for thick envelopes passing through the nip with co-operating drive roller 164. The arrangement of journalizing and biasing the rollers 164 and 166 is the same as that described previously with respect to rollers 46 and 76. The combination and placement of the conveying rollers 164 and 166 is so that the nip is in line with the top surface of the deck 30. In passing through the feed path 14, and typical of all embodiments shown in the accompanying drawings, the bottom surface of the envelopes move along the support deck 30, and arrive at the 164/166 roller nip immediately after the moistening process. If there is any residual sealant that remains on or near the area 140 as defined with respect to the envelope 26, it is squeezed off the envelope 26 and will move down across the surface of cover 164*a* of roller 164. An excess sealant tray 180 is mounted to the machine structure beneath conveying section 160 and excess sealant will be collected as is necessary in tray 180.

Additional features of the invention may be considered, such as providing the lower roller 164 with a polytetrafluoroethylene cover (Teflon®) or other plastic coating like Acetal (Delrin®) which will increase the effectiveness of removal of any excess sealant. Another feature that could be provided is a wiping mechanism that would engage roller 164, to remove any residue and remaining sealant. The wiper could be a serviceable item, replaced when necessary. The present design using an elastomeric cover on these rollers is felt to be effective enough, and provides the desired effective combination of friction to drive the envelopes being processed along the feed path to the output side of the mailing equipment as described previously.

The alternate embodiments described in the present specification are completely adaptable to the sealing process just described for envelopes that are processed using the liquid applicator 100. Both the embodiments for the sealant application the liquid applicator 200 and the liquid applicator 300 fit into the same general space and environment as the liquid applicator 100. The functions relating to application of fluid sealant are the same for each embodiment in that they offer a reliable way to provide a securely sealed envelope as a result of capillary action. The embodiment describing the liquid applicator 300 is also defined as a transfer application device for the sealant, or may be defined as a coating device, contact device, basically the same characteristic as defined in reference to the liquid applicator 200.

Further advantages and modifications will readily occur to those skilled in the art. Therefore, in its broader aspects the invention is not limited to the specific details, and representative devices shown and described herein. Accordingly, various modifications may be made without departing from the spirit or scope of the general inventive concept as defined by the appended claims.

What is claimed is:

1. A moistening apparatus for envelopes, the moistening apparatus comprising:

a conveying apparatus including a first conveying section in the envelope feed path;

an envelope flap closing apparatus located downstream of the first conveying section;

a flap profile sensor located along the feed path; the flap profile sensor detecting an envelope flap profile of a flap of each envelope passing thereby;

a controller operatively connected to the flap profile sensor apparatus, and;

a liquid applicator located downstream of the envelope flap closing apparatus and controlled by the controller to apply a liquid sealing agent to a surface area while the envelope is fed along the feed path, the surface area being adjacent to or overlapping the flap profile so that a glue portion of the flap is moistened by capillary action and the liquid sealant agent along and under an area of the flap; a sealing apparatus including a second conveying section.

2. A moistening apparatus for envelopes, as recited in claim 1 the moistening apparatus comprising:

a pair of sealing rollers comprising a lower roller covered with a liquid resistant material, and an upper roller having a resilient elastomeric covering.

3. A moistening apparatus for envelopes, as recited in claim 1 the moistening apparatus comprising:

a pair of sealing rollers comprising a lower roller covered with polytetrafluroethylene, and an upper roller having a resilient urethane covering.

4. A moistening apparatus for envelopes, the moistening apparatus comprising:

an envelope flap closing apparatus located downstream of a first conveyor;

a flap profile sensor device located along a feed path for detecting an envelope flap profile of a flap of each envelope passing thereby;

a controller operatively connected to the flap profile sensor device, and;

a liquid applicator located downstream of the envelope flap closing apparatus and controlled by the controller to apply a liquid sealing agent to a surface area while the envelope is fed along the feed path, the surface area being adjacent to or overlapping the flap profile so that a glue portion of the flap is moistened by capillary action and the liquid sealant agent along and under an area of the flap, and;

a sealing apparatus including a conveying section.

5. A moistening apparatus for envelopes, the moistening apparatus comprising:

a flap profile sensor device located along a feed path for detecting an envelope flap profile of a flap of each envelope passing thereby;

an envelope flap closing apparatus for positively aligning the envelope flap into a substantially parallel and closed relationship to the envelope;

a controller operatively connected to the flap profile sensor device, and;

a liquid applicator located downstream of the envelope flap closing apparatus and controlled by the controller to apply a sealing agent to a surface area while the envelope is fed along the feed path, the surface area being adjacent to or overlapping the flap profile so that a glue portion of the flap is moistened by capillary action and the liquid sealant agent along and under an area of the flap, and;

a sealing apparatus including a conveying section.

6. A moistening apparatus for envelopes, the moistening apparatus comprising:

an envelope feeding apparatus including a first conveying section in the envelope feed path;

an envelope flap closing apparatus located in the envelope feed path;

a flap profile sensor apparatus located within the feed path;

a control apparatus operatively connected to the flap profile sensor apparatus;

a liquid applicator apparatus located downstream of the envelope flap closing apparatus and being operatively associated with the control apparatus; the applicator apparatus selectively tracking the envelope flap profile during transport of the envelope along the feed path; the applicator apparatus applying the band of liquid sealing agent to a band-like surface area defined by the flap profile of the envelope; the surface area being adjacent to or overlapping the flap profile, and;

a sealing apparatus including a second conveying section.

* * * * *